US011612283B2

(12) United States Patent
Conrad

(10) Patent No.: US 11,612,283 B2
(45) Date of Patent: Mar. 28, 2023

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 454 days.

(21) Appl. No.: 16/797,929

(22) Filed: Feb. 21, 2020

(65) Prior Publication Data

US 2020/0187734 A1 Jun. 18, 2020

Related U.S. Application Data

(63) Continuation of application No. 15/499,151, filed on Apr. 27, 2017, now Pat. No. 10,602,894, which is a (Continued)

(51) Int. Cl.
*A47L 5/24* (2006.01)
*A47L 9/00* (2006.01)
(Continued)

(52) U.S. Cl.
CPC ..... *A47L 5/24* (2013.01); *A47L 9/0018* (2013.01); *A47L 9/0027* (2013.01); *A47L 9/0036* (2013.01); *A47L 9/12* (2013.01); *A47L 9/149* (2013.01); *A47L 9/1608* (2013.01); *A47L 9/1666* (2013.01); *A47L 9/1683* (2013.01); *A47L 9/1691* (2013.01); *A47L 9/242* (2013.01); *A47L 9/2842* (2013.01); *A47L 9/2857* (2013.01); *A47L 9/2894* (2013.01); *A47L 9/322* (2013.01)

(58) Field of Classification Search
CPC . A47L 5/24; A47L 9/12; A47L 1/0018; A47L 9/1608; A47L 9/1666; A47L 9/1683; A47L 9/1691
USPC ..... 15/344, 353, 421, 347
See application file for complete search history.

(56) References Cited

U.S. PATENT DOCUMENTS 911,258 A 2/1909 Neumann
1,600,762 A 9/1926 Hawley
(Continued)

FOREIGN PATENT DOCUMENTS

AU 1127788 A 8/1988
CA 1077412 A1 5/1980
(Continued)

OTHER PUBLICATIONS

English machine translation of DE202011003563U1 published on May 19, 2011.
(Continued)

*Primary Examiner* — Anne M Kozak
*Assistant Examiner* — Shantese L McDonald
(74) *Attorney, Agent, or Firm* — Philip C. Mendes da Costa; Bereskin & Parr LLP/S.E.N.C.R.L., s.r.l.

(57) ABSTRACT

A portable surface cleaning apparatus has a main body and air treatment member assembly is removably mounted to the main body. The air treatment member assembly air outlet and/or the suction motor inlet end is provided at the lower end of the air treatment member assembly when the surface cleaning apparatus is located on a floor and a pre-motor filter underlies the air treatment member assembly and/or the suction motor.

21 Claims, 13 Drawing Sheets

Related U.S. Application Data continuation of application No. 14/932,816, filed on Nov. 4, 2015, now Pat. No. 9,693,666, which is a continuation of application No. 13/040,676, filed on Mar. 4, 2011, now Pat. No. 9,211,044.

(51) Int. Cl.

| | |
|---|---|
| ***A47L 9/16*** | (2006.01) |
| ***A47L 9/28*** | (2006.01) |
| ***A47L 9/12*** | (2006.01) |
| ***A47L 9/14*** | (2006.01) |
| ***A47L 9/24*** | (2006.01) |
| ***A47L 9/32*** | (2006.01) |

(56) References Cited

U.S. PATENT DOCUMENTS

| | | | |
|---|---|---|---|
| 1,779,761 | A | 10/1930 | Alford, Sr. |
| 1,797,812 | A | 3/1931 | Waring |
| 1,898,608 | A | 2/1933 | Alexander |
| 1,937,765 | A | 12/1933 | Leathers |
| 2,015,464 | A | 9/1935 | Saint-Jacques |
| 2,071,975 | A | 2/1937 | Holm-Hansen et al. |
| 2,152,114 | A | 3/1939 | Tongeren |
| 2,533,057 | A | 12/1950 | Senne |
| 2,542,634 | A | 2/1951 | Davis et al. |
| 2,559,384 | A | 7/1951 | Anderson, Jr. |
| 2,621,756 | A | 12/1952 | Senne |
| 2,632,524 | A | 3/1953 | Senne |
| 2,678,110 | A | 5/1954 | Madsen |
| 2,731,102 | A | 1/1956 | James |
| 2,811,219 | A | 10/1957 | Wenzl |
| 2,846,024 | A | 8/1958 | Bremi |
| 2,913,111 | A | 11/1959 | Rogers |
| 2,917,131 | A | 12/1959 | Evans |
| 2,937,713 | A | 5/1960 | Stephenson et al. |
| 2,942,691 | A | 6/1960 | Dillon |
| 2,942,692 | A | 6/1960 | Benz |
| 2,946,451 | A | 7/1960 | Culleton |
| 2,952,330 | A | 9/1960 | Winslow |
| 2,981,369 | A | 4/1961 | Yellott et al. |
| 3,015,122 | A | 1/1962 | Cook |
| 3,023,838 | A | 3/1962 | Gaudry |
| 3,032,954 | A | 5/1962 | Racklyeft |
| 3,085,221 | A | 4/1963 | Kelly |
| 3,130,157 | A | 4/1964 | Kelsall et al. |
| 3,200,568 | A | 8/1965 | McNeil |
| 3,204,772 | A | 9/1965 | Ruxton |
| 3,217,469 | A | 11/1965 | Eckert |
| 3,269,097 | A | 8/1966 | German |
| 3,310,828 | A | 3/1967 | Clark et al. |
| 3,320,727 | A | 5/1967 | Farley et al. |
| 3,356,334 | A | 12/1967 | Scaramucci |
| 3,372,532 | A | 3/1968 | Campbell |
| 3,426,513 | A | 2/1969 | Bauer |
| 3,457,744 | A | 7/1969 | Bisbing |
| 3,518,815 | A | 7/1970 | Peterson et al. |
| 3,530,649 | A | 9/1970 | Porsch et al. |
| 3,561,824 | A | 2/1971 | Homan |
| 3,582,616 | A | 6/1971 | Wrob |
| 3,675,401 | A | 7/1972 | Cordes |
| 3,684,093 | A | 8/1972 | Kono et al. |
| 3,788,044 | A | 1/1974 | McNeil |
| 3,822,533 | A | 7/1974 | Oranje |
| 3,898,068 | A | 8/1975 | McNeil |
| 3,933,450 | A | 1/1976 | Percevaut |
| 3,953,184 | A | 4/1976 | Stockford et al. |
| 3,960,734 | A | 6/1976 | Zagorski |
| 3,988,132 | A | 10/1976 | Oranje |
| 3,988,133 | A | 10/1976 | Schady |
| 4,097,381 | A | 6/1978 | Ritzler |
| 4,187,088 | A | 2/1980 | Hodgson |
| 4,218,805 | A | 8/1980 | Brazier |
| 4,236,903 | A | 12/1980 | Malmsten |
| 4,373,228 | A | 2/1983 | Dyson |
| 4,382,804 | A | 5/1983 | Mellor |
| 4,393,536 | A | 7/1983 | Tapp |
| 4,409,008 | A | 10/1983 | Solymes |
| 4,443,910 | A | 4/1984 | Fitzwater |
| 4,486,207 | A | 12/1984 | Baillie |
| 4,573,236 | A | 3/1986 | Dyson |
| 4,635,315 | A | 1/1987 | Kozak |
| 4,678,588 | A | 7/1987 | Shortt |
| 4,744,958 | A | 5/1988 | Pircon |
| 4,778,494 | A | 10/1988 | Patterson |
| 4,790,865 | A | 12/1988 | DeMarco |
| 4,809,393 | A | 3/1989 | Goodrich et al. |
| 4,809,398 | A | 3/1989 | Lindquist et al. |
| 4,826,515 | A | 5/1989 | Dyson |
| 4,831,685 | A | 5/1989 | Bosyj et al. |
| 4,836,515 | A | 6/1989 | Franz et al. |
| 4,853,008 | A | 8/1989 | Dyson |
| 4,853,011 | A | 8/1989 | Dyson |
| 4,905,342 | A | 3/1990 | Maka |
| 5,054,157 | A | 10/1991 | Werner et al. |
| 5,078,761 | A | 1/1992 | Dyson |
| 5,080,697 | A | 1/1992 | Finke |
| 5,090,976 | A | 2/1992 | Dyson |
| 5,129,125 | A | 7/1992 | Gamou et al. |
| 5,139,652 | A | 8/1992 | LeBlanc |
| 5,230,722 | A | 7/1993 | Yonkers |
| 5,254,019 | A | 10/1993 | Noschese |
| 5,267,371 | A | 12/1993 | Soler et al. |
| 5,287,591 | A | 2/1994 | Rench et al. |
| 5,309,600 | A | 5/1994 | Weaver et al. |
| 5,309,601 | A | 5/1994 | Hampton et al. |
| 5,331,714 | A | 7/1994 | Essex et al. |
| 5,391,051 | A | 2/1995 | Sabatier et al. |
| 5,481,780 | A | 1/1996 | Daneshvar |
| 5,524,321 | A | 6/1996 | Weaver et al. |
| 5,599,365 | A | 2/1997 | Alday et al. |
| 5,681,450 | A | 10/1997 | Chitnis et al. |
| 5,715,566 | A | 2/1998 | Weaver et al. |
| 5,755,096 | A | 5/1998 | Holleyman |
| 5,836,047 | A | 11/1998 | Lee et al. |
| 5,842,254 | A | 12/1998 | Lee |
| 5,858,038 | A | 1/1999 | Dyson et al. |
| 5,858,043 | A | 1/1999 | Geise |
| 5,893,938 | A | 4/1999 | Dyson et al. |
| 5,922,093 | A | 7/1999 | James et al. |
| 5,935,279 | A | 8/1999 | Kilstroem |
| 5,950,274 | A | 9/1999 | Kilstrom |
| 5,958,094 | A | 9/1999 | Schwamborn et al. |
| 6,026,540 | A | 2/2000 | Wright et al. |
| 6,058,559 | A | 5/2000 | Yoshimi et al. |
| 6,070,291 | A | 6/2000 | Bair et al. |
| 6,071,095 | A | 6/2000 | Verkaart |
| 6,071,321 | A | 6/2000 | Trapp et al. |
| 6,080,022 | A | 6/2000 | Shaberman et al. |
| 6,081,961 | A | 7/2000 | Wang |
| 6,122,796 | A | 9/2000 | Downham et al. |
| 6,168,641 | B1 | 1/2001 | Tuvin et al. |
| 6,171,356 | B1 | 1/2001 | Twerdun |
| 6,173,474 | B1 | 1/2001 | Conrad |
| 6,192,550 | B1 | 2/2001 | Hamada et al. |
| 6,210,469 | B1 | 4/2001 | Tokar |
| 6,221,134 | B1 | 4/2001 | Conrad et al. |
| 6,228,260 | B1 | 5/2001 | Conrad et al. |
| 6,231,645 | B1 | 5/2001 | Conrad et al. |
| 6,231,649 | B1 * | 5/2001 | Dyson ..... A47L 9/19 55/467 |
| 6,251,296 | B1 | 6/2001 | Conrad et al. |
| 6,256,832 | B1 | 7/2001 | Dyson |
| 6,256,834 | B1 | 7/2001 | Meijer et al. |
| 6,260,234 | B1 | 7/2001 | Wright et al. |
| 6,295,692 | B1 | 10/2001 | Shideler |
| 6,334,234 | B1 | 1/2002 | Conrad et al. |
| 6,353,963 | B1 | 3/2002 | Bair et al. |
| 6,398,834 | B2 | 6/2002 | Oh |
| 6,406,505 | B1 | 6/2002 | Oh et al. |
| 6,432,154 | B2 | 8/2002 | Oh et al. |
| 6,434,785 | B1 | 8/2002 | Vandenbelt et al. |
| 6,440,197 | B1 | 8/2002 | Conrad et al. |
| 6,463,622 | B2 | 10/2002 | Wright et al. |

(56) References Cited

U.S. PATENT DOCUMENTS 6,482,246 B1 11/2002 Dyson et al.
6,510,583 B2 1/2003 Griffin et al.
6,531,066 B1 3/2003 Saunders et al.
6,532,620 B2 3/2003 Oh
6,553,612 B1 4/2003 Dyson et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,648,934 B2 11/2003 Choi et al.
6,706,095 B2 3/2004 Morgan
6,735,818 B2 5/2004 Hamada et al.
6,736,873 B2 5/2004 Conrad et al.
6,746,500 B1 6/2004 Park et al.
6,782,583 B2 8/2004 Oh
6,782,585 B1 8/2004 Conrad et al.
6,810,558 B2 11/2004 Lee
6,832,408 B2 12/2004 Roney et al.
6,833,015 B2 12/2004 Oh et al.
6,848,146 B2 2/2005 Wright et al.
6,868,578 B1 3/2005 Kasper et al.
6,874,197 B1 4/2005 Conrad et al.
6,896,719 B2 5/2005 Coates et al.
6,901,625 B2 6/2005 Yang et al.
6,902,596 B2 6/2005 Conrad et al.
6,910,245 B2 6/2005 Hawkins et al.
6,929,516 B2 8/2005 Brochu et al.
6,961,975 B2 11/2005 Park et al.
6,968,596 B2 11/2005 Oh et al.
6,976,885 B2 12/2005 Lord
7,036,183 B2 5/2006 Gammack et al.
7,039,985 B2 5/2006 Hisrich et al.
7,065,826 B1 6/2006 Arnold
7,073,226 B1 7/2006 Lenkiewicz et al.
7,086,119 B2 8/2006 Go et al.
7,127,397 B2 10/2006 Case
7,131,165 B2 11/2006 Wright et al.
7,146,681 B2 12/2006 Wright et al.
7,160,346 B2 1/2007 Park
7,175,682 B2 2/2007 Nakai et al.
7,207,083 B2 4/2007 Hayashi et al.
7,222,393 B2 5/2007 Kaffenberger et al.
7,278,181 B2 10/2007 Harris et al.
7,309,365 B2 12/2007 Yuasa et al.
7,341,611 B2 3/2008 Greene et al.
7,354,468 B2 4/2008 Arnold et al.
7,356,874 B2 4/2008 Skinner Macleod et al.
7,370,387 B2 5/2008 Walker et al.
7,377,008 B2 5/2008 Park et al.
7,377,953 B2 5/2008 Oh
7,380,308 B2 6/2008 Oh et al.
7,381,234 B2 6/2008 Oh
7,386,916 B2 6/2008 Bone
7,395,579 B2 7/2008 Oh
7,410,516 B2 8/2008 Ivarsson et al.
7,419,521 B2 9/2008 Oh et al.
D581,609 S 11/2008 Conrad et al.
7,448,363 B1 11/2008 Rasmussen et al.
7,449,040 B2 11/2008 Conrad et al.
7,485,164 B2 2/2009 Jeong et al.
7,488,363 B2 2/2009 Jeong et al.
7,544,224 B2 6/2009 Tanner et al.
7,547,338 B2 6/2009 Kim et al.
7,555,810 B2 7/2009 Pullins et al.
7,581,286 B2 9/2009 Choi
7,588,616 B2 9/2009 Conrad et al.
7,594,296 B2 9/2009 Park
7,597,730 B2 10/2009 Yoo et al.
7,604,675 B2 10/2009 Makarov et al.
7,618,470 B2 11/2009 Eddington et al.
7,624,475 B2 12/2009 Choi
7,645,309 B2 1/2010 Jeong et al.
7,645,311 B2 1/2010 Oh et al.
7,686,858 B2 3/2010 Oh
7,731,769 B2 6/2010 Min
7,736,408 B2 6/2010 Böck et al.
7,740,676 B2 6/2010 Burnham et al.
7,776,116 B2 8/2010 Oh et al.
7,776,120 B2 8/2010 Conrad
7,779,505 B2 8/2010 Krebs et al.
7,779,506 B2 8/2010 Kang et al.
7,803,205 B2 9/2010 Oh et al.
7,803,207 B2 9/2010 Conrad
7,867,308 B2 1/2011 Conrad
7,882,592 B2 2/2011 Hwang et al.
7,887,612 B2 2/2011 Conrad
7,922,794 B2 4/2011 Morphey
7,934,286 B2 5/2011 Yoo et al.
7,938,871 B2 5/2011 Lloyd
7,941,895 B2 5/2011 Conrad
7,979,953 B2 7/2011 Yoo
8,015,659 B2 9/2011 Conrad et al.
8,021,453 B2 9/2011 Howes
8,032,981 B2 10/2011 Yoo
8,032,983 B2 10/2011 Griffith et al.
8,034,140 B2 10/2011 Conrad
8,048,180 B2 11/2011 Oh et al.
8,062,398 B2 11/2011 Luo et al.
8,100,999 B2 1/2012 Ashbee et al.
8,117,713 B2 2/2012 Kasper et al.
8,127,397 B2 3/2012 Hess et al.
8,127,398 B2 3/2012 Conrad
8,166,607 B2 5/2012 Conrad
8,191,203 B2 6/2012 Yoo
8,296,900 B2 10/2012 Conrad
8,359,705 B2 1/2013 Conrad
8,468,464 B2 6/2013 Abramson et al.
8,468,646 B2 6/2013 Yoo
8,484,799 B2 7/2013 Conrad
8,528,160 B2 9/2013 Conrad
8,769,767 B2 7/2014 Conrad
2001/0054213 A1 12/2001 Oh et al.
2002/0011050 A1 1/2002 Hansen et al.
2002/0020154 A1 2/2002 Yang
2002/0026775 A1 3/2002 Murphy et al.
2002/0062531 A1 5/2002 Oh
2002/0088208 A1 7/2002 Lukac et al.
2002/0112315 A1 8/2002 Conrad
2002/0124538 A1 9/2002 Oh et al.
2002/0134059 A1 9/2002 Oh
2002/0162188 A1 11/2002 Harmen
2002/0178535 A1 12/2002 Oh et al.
2002/0178698 A1 12/2002 Oh et al.
2002/0178699 A1 12/2002 Oh
2003/0028994 A1 2/2003 Kitamura et al.
2003/0158238 A1 8/2003 Hale et al.
2003/0159238 A1 8/2003 Oh
2003/0159411 A1 8/2003 Hansen et al.
2003/0200736 A1 10/2003 Ni
2003/0226232 A1 12/2003 Hayashi et al.
2004/0010885 A1 1/2004 Hitzelberger et al.
2004/0025285 A1 2/2004 McCormick et al.
2004/0060146 A1 4/2004 Coates et al.
2004/0112022 A1 6/2004 Vuijk
2004/0128789 A1* 7/2004 Harris ..... A47L 9/02 15/353
2004/0163201 A1 8/2004 Murphy et al.
2004/0194249 A1 10/2004 Lee et al.
2004/0216263 A1 11/2004 Best et al.
2004/0216264 A1 11/2004 Shaver et al.
2004/0216266 A1 11/2004 Conrad
2004/0237248 A1 12/2004 Oh et al.
2004/0261213 A1 12/2004 Park et al.
2005/0000054 A1 1/2005 Ninomiya et al.
2005/0050678 A1 3/2005 Oh et al.
2005/0125939 A1 6/2005 Hansen et al.
2005/0132529 A1 6/2005 Davidshofer
2005/0138757 A1 6/2005 Lee
2005/0144754 A1 7/2005 Ivarsson et al.
2005/0198767 A1 9/2005 Kang et al.
2005/0198769 A1 9/2005 Lee et al.

(56) References Cited

U.S. PATENT DOCUMENTS

2005/0198770 A1 9/2005 Jung et al.
2005/0252179 A1 11/2005 Oh et al.
2006/0005346 A1 1/2006 Rupp et al.
2006/0037172 A1 2/2006 Choi
2006/0080947 A1 4/2006 Lee et al.
2006/0090290 A1 5/2006 Lau
2006/0123590 A1 6/2006 Fester et al.
2006/0137304 A1 6/2006 Jeong et al.
2006/0137305 A1 6/2006 Jung
2006/0137306 A1 6/2006 Jeong et al.
2006/0137307 A1* 6/2006 Jeong ..... B04C 5/081 15/327.2
2006/0137309 A1 6/2006 Jeong et al.
2006/0156508 A1 7/2006 Khalil
2006/0156509 A1 7/2006 Luebbering et al.
2006/0156699 A1 7/2006 Kim
2006/0162298 A1 7/2006 Oh et al.
2006/0162299 A1 7/2006 North
2006/0168923 A1 8/2006 Lee et al.
2006/0191099 A1 8/2006 Fry et al.
2006/0207231 A1 9/2006 Arnold
2006/0230715 A1 10/2006 Oh et al.
2006/0230724 A1 10/2006 Han et al.
2006/0230726 A1 10/2006 Oh et al.
2006/0236663 A1 10/2006 Oh
2006/0248678 A1 11/2006 Park
2006/0278081 A1 12/2006 Han et al.
2007/0012002 A1 1/2007 Oh et al.
2007/0039120 A1 2/2007 Choi
2007/0067944 A1 3/2007 Kitamura et al.
2007/0067945 A1 3/2007 Kasper et al.
2007/0077810 A1 4/2007 Gogel et al.
2007/0079473 A1 4/2007 Min et al.
2007/0079584 A1 4/2007 Kim et al.
2007/0079585 A1 4/2007 Oh et al.
2007/0079587 A1 4/2007 Kim
2007/0084160 A1 4/2007 Kim
2007/0084161 A1 4/2007 Yoo
2007/0095028 A1 5/2007 Kim et al.
2007/0095029 A1 5/2007 Min et al.
2007/0209334 A1 9/2007 Conrad
2007/0226946 A1 10/2007 Best
2007/0226947 A1 10/2007 Kang
2007/0240275 A1 10/2007 Willenbring
2007/0251048 A1* 11/2007 Choi ..... A47L 5/225 15/352
2007/0262512 A1 11/2007 Watanabe et al.
2007/0266683 A1 11/2007 McDowell
2007/0271724 A1 11/2007 Hakan et al.
2007/0289085 A1 12/2007 Yoo
2007/0289089 A1 12/2007 Yacobi
2007/0289267 A1 12/2007 Makarov et al.
2008/0040883 A1 2/2008 Beskow et al.
2008/0047091 A1 2/2008 Nguyen
2008/0083085 A1 4/2008 Genn
2008/0104793 A1 5/2008 Kang et al.
2008/0115312 A1 5/2008 DiPasquale et al.
2008/0134460 A1 6/2008 Conrad
2008/0134462 A1 6/2008 Jansen et al.
2008/0172821 A1* 7/2008 Kang ..... A47L 5/362 15/327.5
2008/0172992 A1 7/2008 Conrad
2008/0172995 A1 7/2008 Conrad
2008/0178416 A1 7/2008 Conrad
2008/0184681 A1 8/2008 Oh et al.
2008/0190080 A1 8/2008 Oh et al.
2008/0196194 A1 8/2008 Conrad
2008/0196196 A1 8/2008 Conrad
2008/0216282 A1 9/2008 Conrad
2008/0250601 A1 10/2008 Coburn
2008/0282497 A1 11/2008 Griffith et al.
2009/0000054 A1 1/2009 Hampton et al.
2009/0031522 A1 2/2009 Yoo et al.
2009/0044371 A1 2/2009 Yoo et al.
2009/0106932 A1 4/2009 Courtney
2009/0113659 A1 5/2009 Jeon et al.
2009/0113663 A1 5/2009 Follows et al.
2009/0133370 A1 5/2009 Yoo et al.
2009/0144929 A1 6/2009 Yoo
2009/0144932 A1 6/2009 Yoo
2009/0165431 A1 7/2009 Oh
2009/0178229 A1 7/2009 Yoo
2009/0178568 A1 7/2009 Yoo
2009/0181841 A1 7/2009 Conrad
2009/0193610 A1 8/2009 Gabric
2009/0193771 A1 8/2009 Oh et al.
2009/0205160 A1 8/2009 Conrad
2009/0205161 A1 8/2009 Conrad
2009/0209403 A1 8/2009 Conrad
2009/0209666 A1 8/2009 Hellberg et al.
2009/0217635 A1 9/2009 Bertram et al.
2009/0300873 A1 12/2009 Grey
2009/0307864 A1 12/2009 Dyson
2010/0005611 A1 1/2010 Hong et al.
2010/0005617 A1 1/2010 Hyun et al.
2010/0037420 A1 2/2010 Lee
2010/0043170 A1 2/2010 Ni
2010/0071153 A1 3/2010 Genn
2010/0095476 A1 4/2010 Kim et al.
2010/0115727 A1 5/2010 Oh
2010/0162515 A1 7/2010 Stephens
2010/0175217 A1 7/2010 Conrad
2010/0175219 A1 7/2010 Soen et al.
2010/0212104 A1* 8/2010 Conrad ..... B29C 66/73921 15/347
2010/0224073 A1 9/2010 Oh et al.
2010/0229336 A1 9/2010 Conrad
2010/0229338 A1 9/2010 Conrad
2010/0242222 A1 9/2010 Conrad
2010/0293745 A1 11/2010 Coburn
2010/0299865 A1 12/2010 Conrad
2011/0023262 A1 2/2011 Conrad
2011/0214250 A1 9/2011 McLeod et al.
2011/0219570 A1 9/2011 Conrad
2011/0219573 A1 9/2011 Conrad
2011/0219574 A1 9/2011 Conrad
2011/0314629 A1 12/2011 Conrad
2012/0000030 A1 1/2012 Conrad
2012/0030895 A1 2/2012 Chong et al.
2012/0030898 A1 2/2012 Crouch et al.
2012/0047682 A1 3/2012 Makarov et al.
2012/0159734 A1 6/2012 Fujiwara
2012/0180662 A1 7/2012 Missalla et al.
2012/0222235 A1 9/2012 Lenkiewicz et al.
2012/0222245 A1 9/2012 Conrad
2012/0272472 A1 11/2012 Conrad
2013/0091660 A1 4/2013 Smith
2013/0091661 A1 4/2013 Smith
2013/0091812 A1 4/2013 Smith
2013/0091813 A1 4/2013 Smith
2013/0104335 A1 5/2013 Conrad
2013/0145575 A1 6/2013 Conrad
2014/0237768 A1 8/2014 Conrad
2016/0367094 A1 12/2016 Conrad

FOREIGN PATENT DOCUMENTS

CA 2438079 A1 9/2002
CA 2658014 A1 9/2010
CN 2524655 Y 12/2002
CN 2534954 Y 2/2003
CN 1506016 A 6/2004
CN 1765283 A 5/2006
CN 1806741 A 7/2006
CN 1875855 A 12/2006
CN 1887437 A 1/2007
CN 1895148 A 1/2007
CN 101073480 A 11/2007
CN 201101488 Y 8/2008
CN 101357051 A 2/2009
CN 201290642 Y 8/2009
CN 101657133 A 2/2010
CN 102188208 A 9/2011
CN 103040412 A 4/2013

(56) References Cited

FOREIGN PATENT DOCUMENTS

| | | | |
|---|---|---|---|
| CN | 103040413 | A | 4/2013 |
| DE | 875134 | C | 4/1953 |
| DE | 3734355 | C2 | 6/1989 |
| DE | 9216071 | U1 | 2/1993 |
| DE | 4232382 | C1 | 3/1994 |
| DE | 69907201 | T2 | 2/2004 |
| DE | 60201666 | T2 | 6/2006 |
| DE | 60033986 | T2 | 11/2007 |
| DE | 112007003039 | T5 | 10/2009 |
| DE | 112007003052 | T5 | 1/2010 |
| DE | 202011003563 | U1 | 5/2011 |
| DE | 112010001135 | T5 | 8/2012 |
| DE | 202010018047 | U1 | 11/2013 |
| DE | 202010018084 | U1 | 2/2014 |
| DE | 202010018085 | U1 | 2/2014 |
| EP | 489468 | A1 | 6/1992 |
| EP | 1200196 | B1 | 6/2005 |
| EP | 1674009 | A2 | 6/2006 |
| EP | 1779761 | A2 | 5/2007 |
| EP | 2471429 | A3 | 11/2013 |
| GB | 700791 | A | 12/1953 |
| GB | 1111074 | A | 4/1968 |
| GB | 2163703 | B | 1/1988 |
| GB | 2282979 | B | 10/1997 |
| JP | 2000140533 | A | 5/2000 |
| JP | 2004121722 | A | 4/2004 |
| JP | 2005040246 | A | 2/2005 |
| JP | 2005087508 | A | 4/2005 |
| JP | 2009261501 | A | 11/2009 |
| JP | 2010081968 | A | 4/2010 |
| JP | 2010227287 | A | 10/2010 |
| WO | 3002561 | A1 | 11/1980 |
| WO | 9400046 | A1 | 1/1994 |
| WO | 9627446 | A1 | 9/1996 |
| WO | 9809121 | A1 | 3/1998 |
| WO | 9843721 | A1 | 10/1998 |
| WO | 2007021043 | A1 | 2/2007 |
| WO | 2006026414 | A3 | 8/2007 |
| WO | 2008009890 | A1 | 1/2008 |
| WO | 2007084699 | A3 | 2/2008 |
| WO | 2008034325 | A1 | 3/2008 |
| WO | 2009026709 | A1 | 3/2009 |
| WO | 2009026714 | A1 | 3/2009 |
| WO | 2009076774 | A1 | 6/2009 |
| WO | 2010102396 | A1 | 9/2010 |
| WO | 2010147247 | A1 | 12/2010 |
| WO | 2011054106 | A1 | 5/2011 |

OTHER PUBLICATIONS

English machine translation of DE202010018085U1 published on Feb. 27, 2014.
English machine translation of DE202010018084U1 published on Feb. 27, 2014.
English machine translation of De202010018047U1 published on Nov. 14, 2013.
English machine translation of DE112010001135T5 published on Aug. 2, 2012.
English machine translation of DE1120112007003052T5 published on Jan. 14, 2010.
English machine translation of DE112007003039T5 published on Oct. 29, 2009.
English machine translation of JP2010227287A published on Oct. 14, 2010.
English machine translation of JP2010081968A published on Apr. 15, 2010.
English machine translation of JP2009261501 published on Nov. 12, 2009.
English machine translation of JP2005087508 published on Apr. 7, 2005.
English machine translation of JP2005040246 published on Feb. 17, 2005.
English machine translation of JP2004121722 published on Apr. 22, 2004.
English machine translation of JP2000140533 published on May 23, 2000.
English machine translation of CN201290642 published on Aug. 19, 2009.
English machine translation of CN201101488 published on Aug. 20, 2008.
English machine translation of CN103040413 published on Apr. 17, 2013.
English machine translation of CN103040412 published on Apr. 17, 2013.
English machine translation of CN102188208 published on Sep. 21, 2011.
English machine translation of CN101657133 published on Feb. 24, 2010.
English machine translation of CN101357051 published on Feb. 4, 2009.
English machine translation of CN101073480 published on Nov. 21, 2007.
English machine translation of DE69907201 published on Feb. 5, 2004.
English machine translation DE60201666 published on Jun. 1, 2006.
English machine translation of DE60033986T2 published on Nov. 29, 2007.
English machine translation of DE9216071U1 published on Feb. 25, 1993.
English machine translation of DE4232382C1 published on Mar. 24, 1994.
English machine translation of DE3734355C2 published on Jun. 29, 1989.
English machine translation of CN2534954Y published on Feb. 12, 2003.
English machine translation of CN2524655Y published on Dec. 11, 2002.
English machine translation of CN1895148A published on Jan. 17, 2007.
English machine translation of CN1887437A published on Jan. 3, 2007.
English machine translation of CN1875855A published on Dec. 13, 2006.
English machine translation of CN1806741A published on Jul. 26, 2006.
English machine translation of CN1765283A published on May 3, 2006.
English machine translation of CN1506016A published on Jun. 23, 2004.
English machine translation of DE875134C published on Apr. 30, 1953.
International Search Report and Written Opinion, International Application No. PCT/CA2012/000185, dated Jun. 28, 2012.
Cheremisinoff, "Handbook of Air Pollution Prevention and Control", Butterworth-Heinemann, Elsevier Science (USA), 2002, pp. 397-404.

* cited by examiner

SURFACE CLEANING APPARATUS

CROSS REFERENCE TO RELATED APPLICATION

This application is a continuation of co-pending U.S. patent application Ser. No. 15/499,151, filed on Apr. 27, 2017, which is allowed, which application is a continuation of U.S. patent application Ser. No. 14/932,816, filed on Nov. 4, 2015, and now U.S. Pat. No. 9,693,666 which is a continuation of U.S. patent application Ser. No. 13/040,676, filed on Mar. 4, 2011 and now U.S. Pat. No. 9,211,044, each of which is herein incorporated by reference in its entirety.

FIELD OF INVENTION

The disclosure relates to surface cleaning apparatuses, such as vacuum cleaners.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY OF THE INVENTION

The following summary is provided to introduce the reader to the more detailed discussion to follow. The summary is not intended to limit or define the claims.

According to one broad aspect, a surface cleaning apparatus has a main body with a removable air treatment member, which preferably comprises a cyclone bin assembly, comprising a cyclone chamber and a dirt collection chamber. The surface cleaning apparatus also has a suction hose connector to which a flexible suction hose may be connected, and optionally releasably connected. The downstream side of the suction hose connector is in fluid communication with the cyclone chamber.

Preferably, the suction hose connector is fixedly connected to the main body, so that the suction hose connector remains connected to the body when the cyclone bin assembly is removed. An advantage of this configuration may be that it allows the cyclone bin assembly to be separated from the suction hose connector, and the associated suction hose, when the cyclone bin assembly is detached from the body. This may allow a user to manipulate the cyclone bin assembly without also having to handle the flexible suction hose.

Preferably, at least a portion of the suction hose connector is nested within the cyclone bin assembly. For example, the downstream end of the suction hose connector can be nested within the dirt collection chamber. An advantage of this configuration may be that the overall size of the surface cleaning apparatus may be reduced. Further, the suction hose connecter may be protected or partially protected from impact.

Preferably, the downstream side of the suction hose connector is connectable to a tangential air inlet of the cyclone chamber. More preferably, the tangential air inlet is automatically connected to the suction hose connector when the cyclone bin assembly is placed on the main body.

In accordance with this broad aspect, a surface cleaning apparatus comprises an air flow path extending from a dirty air inlet to a clean air outlet. The surface cleaning apparatus may also comprise a main body comprising a suction motor provided in the air flow path. A cyclone bin assembly may be provided in the air flow path and may be removably mounted to the main body. The cyclone bin assembly may comprise a cyclone chamber. A hose connector may be provided on the main body. The hose connector may comprise a portion of the air flow path from the dirty air inlet to the cyclone bin assembly.

The hose connector may be nested in the cyclone bin assembly when the cyclone bin assembly is mounted to the main body.

The hose connector may be in line with a tangential inlet of the cyclone chamber.

The cyclone bin assembly may comprise a dirt collection chamber and the hose connector may be nested in the dirt collection chamber.

The main body may comprise a platform on which the cyclone bin assembly is removably mounted. The hose connector may be provided on the platform.

The hose connector may be fixedly provided on the platform.

The cyclone bin assembly may have a recess for removably receiving the hose connector.

The recess may be provided in a lower surface of the cyclone bin assembly.

The hose connector may be slidably receivable in the recess.

The cyclone bin assembly is mountable on the main body upon movement in a particular direction. The hose connector may have a flange at an air outlet end of the hose connector and the flange may be sealingly mateable with a wall extending in the particular direction.

The surface cleaning apparatus may comprise a flexible suction hose extending between a cleaning head or cleaning tool and the hose connector.

The surface cleaning apparatus may be a portable surface cleaning apparatus.

The cyclone bin assembly further may comprise a handle for the surface cleaning apparatus.

In accordance with this broad aspect, a surface cleaning apparatus may alternately comprise an air flow path extending from a dirty air inlet to a clean air outlet. The surface cleaning apparatus may also comprise a main body comprising a suction motor provided in the air flow path. A cyclone bin assembly may be provided in the air flow path and may be removably mounted to the main body. The cyclone bin assembly may comprise a cyclone chamber. The hose connector may comprise a portion of the air flow path from the dirty air inlet to the cyclone bin assembly wherein the hose connector is nested in the cyclone bin assembly.

The hose connector may be in line with a tangential inlet of the cyclone chamber.

The main body may comprise a platform on which the cyclone bin assembly is removably mounted.

The cyclone bin assembly may have a recess provided in a lower surface of the cyclone bin assembly in which the hose connector is mounted.

The surface cleaning apparatus may be a portable surface cleaning apparatus and, preferably, the cyclone bin assembly further comprises a handle for the surface cleaning apparatus.

DRAWINGS

Reference is made in the detailed description to the accompanying drawings, in which.

DETAILED DESCRIPTION

Figure 1:
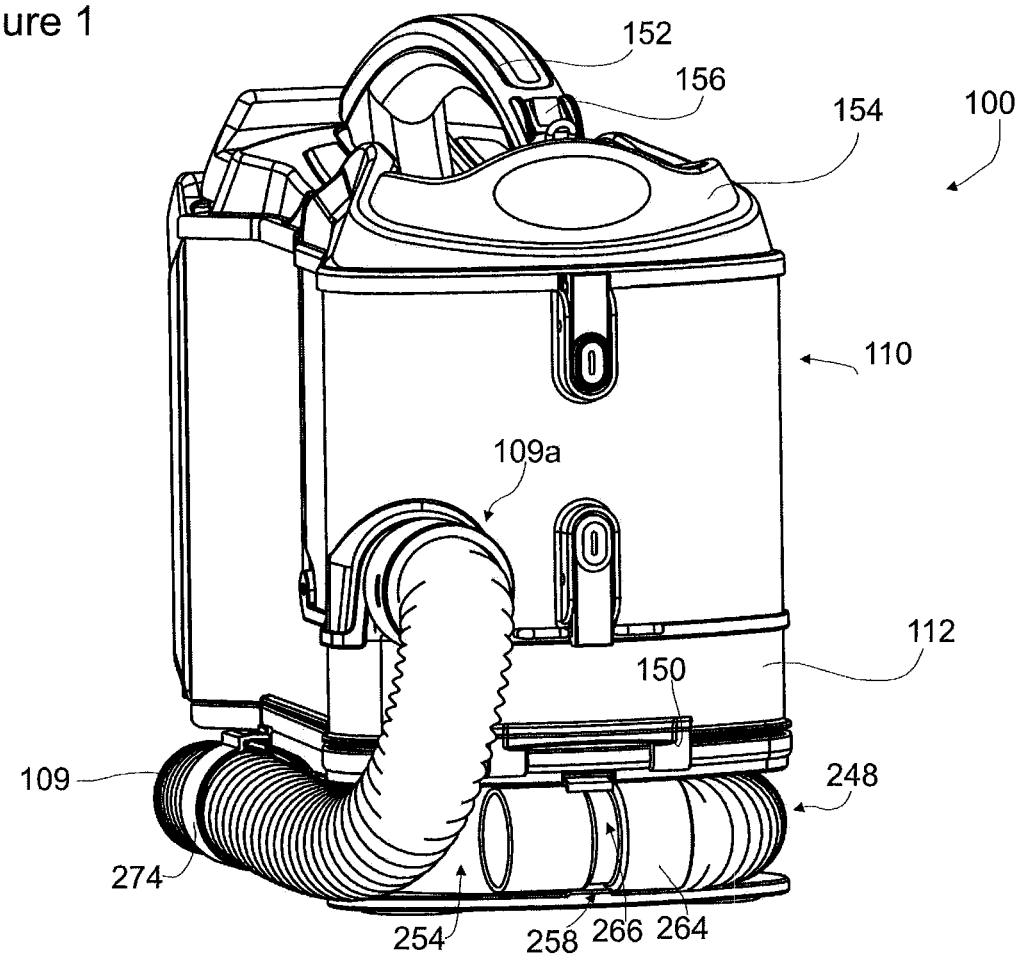
FIG. 1 is a perspective view of an example of a surface cleaning apparatus.

Referring to FIG. 1, an embodiment of a surface cleaning apparatus 100 is shown. In the embodiment illustrated, the surface cleaning apparatus 100 is a hand operable surface cleaning apparatus. In alternate embodiments, the surface cleaning apparatus may be another suitable type of surface cleaning apparatus, including, for example, an upright vacuum cleaner, a canister vacuum cleaner, a stick vac, a wet-dry vacuum cleaner and a carpet extractor. Power can be supplied to the surface cleaning apparatus 100 by an electrical cord (not shown) that can be connected to a standard wall electrical outlet. Alternatively, or in addition, the power source for the surface cleaning apparatus can be an onboard power source, including, for example, one or more batteries.

General Overview

Figure 2:
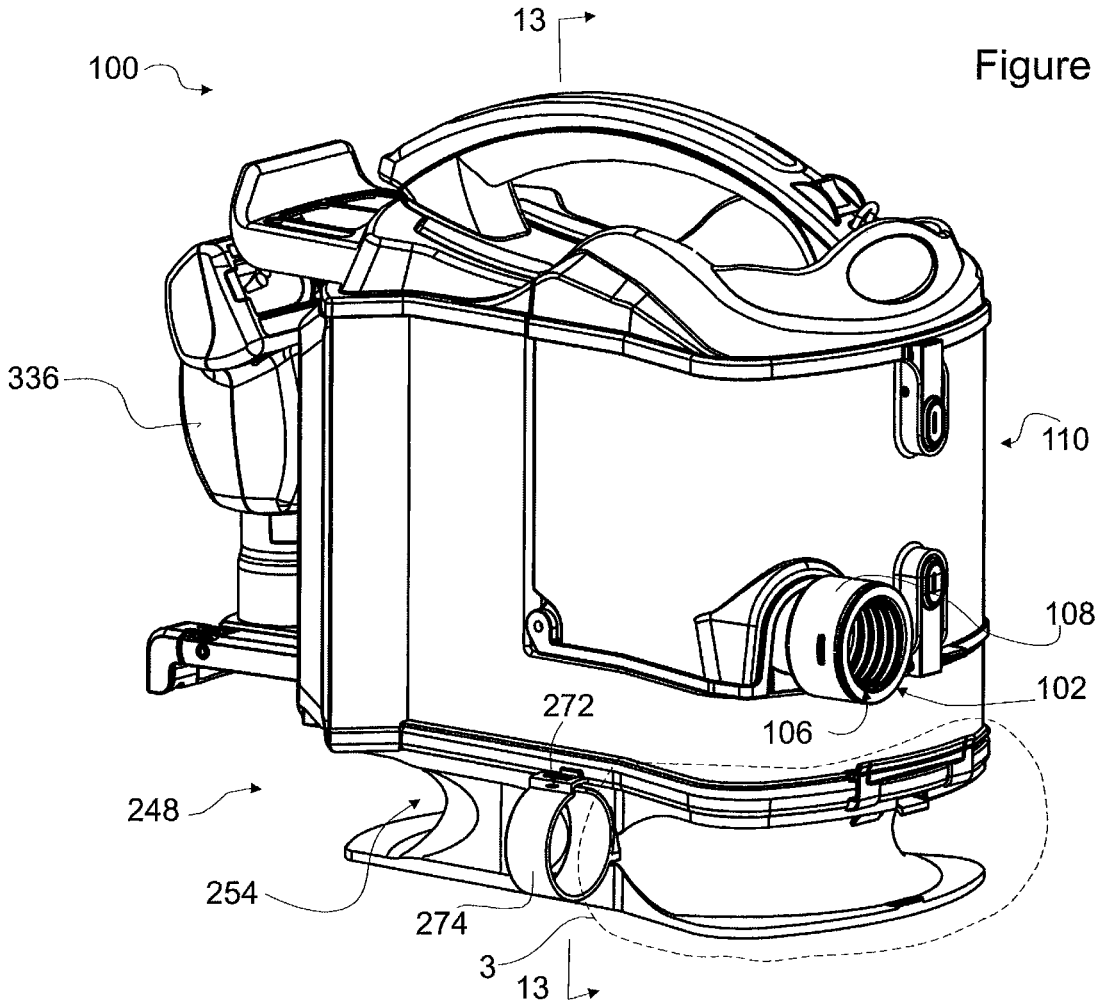
FIG. 2 is a perspective view of the surface cleaning apparatus shown in FIG. 1, with a suction hose removed.

Referring to FIGS. 1 and 2, the surface cleaning apparatus 100 has a dirty air inlet 102, a clean air outlet 104 (see for example FIGS. 4 and 13) and an airflow passage extending therebetween. In the embodiment shown, the dirty air inlet 102 is the air inlet 106 of a suction hose connector 108 that can be connected to the downstream end 109*a* of a flexible suction hose 109 or other type of cleaning accessory tool, including, for example, a wand and a nozzle. From the dirty air inlet 102, the airflow passage extends through an air treatment member that can treat the air in a desired manner, including for example removing dirt particles and debris from the air. In the illustrated example, the air treatment member comprises a cyclone bin assembly 110. The cyclone bin assembly 110 is mounted on a main body 112. Alternatively, the air treatment member can comprise a bag, a filter or other air treating means. A suction motor 114 (FIG. 13) is mounted within the body 112 and is in fluid communication with the cyclone bin assembly 110.

Figure 13:
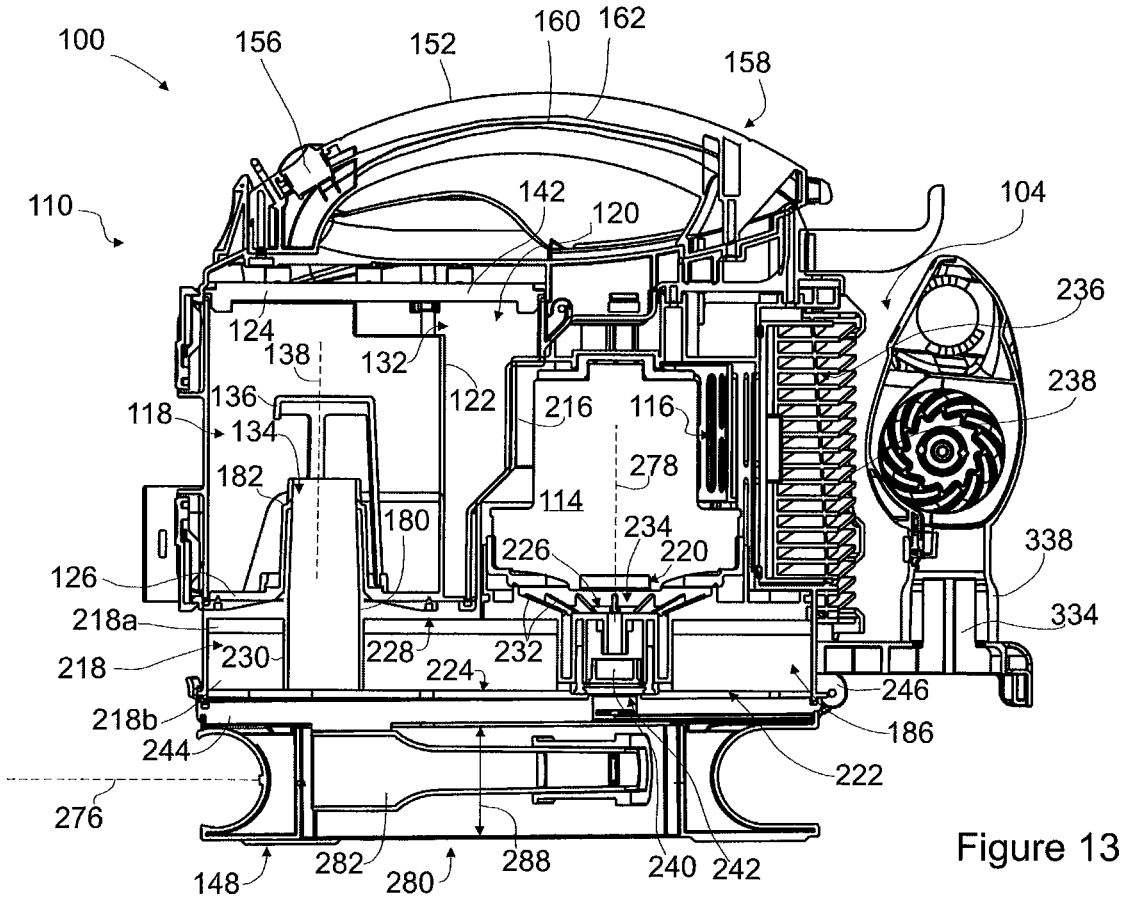

Referring to FIG. 13, the clean air outlet 104, which is in fluid communication with an outlet 116 of the suction motor 114, is provided in the body 112. In the illustrated example, the dirty air inlet 102 is located toward the front of the surface cleaning apparatus 100, and the clear air outlet 104 is located toward the rear.

Cyclone Bin Assembly

Figure 9:
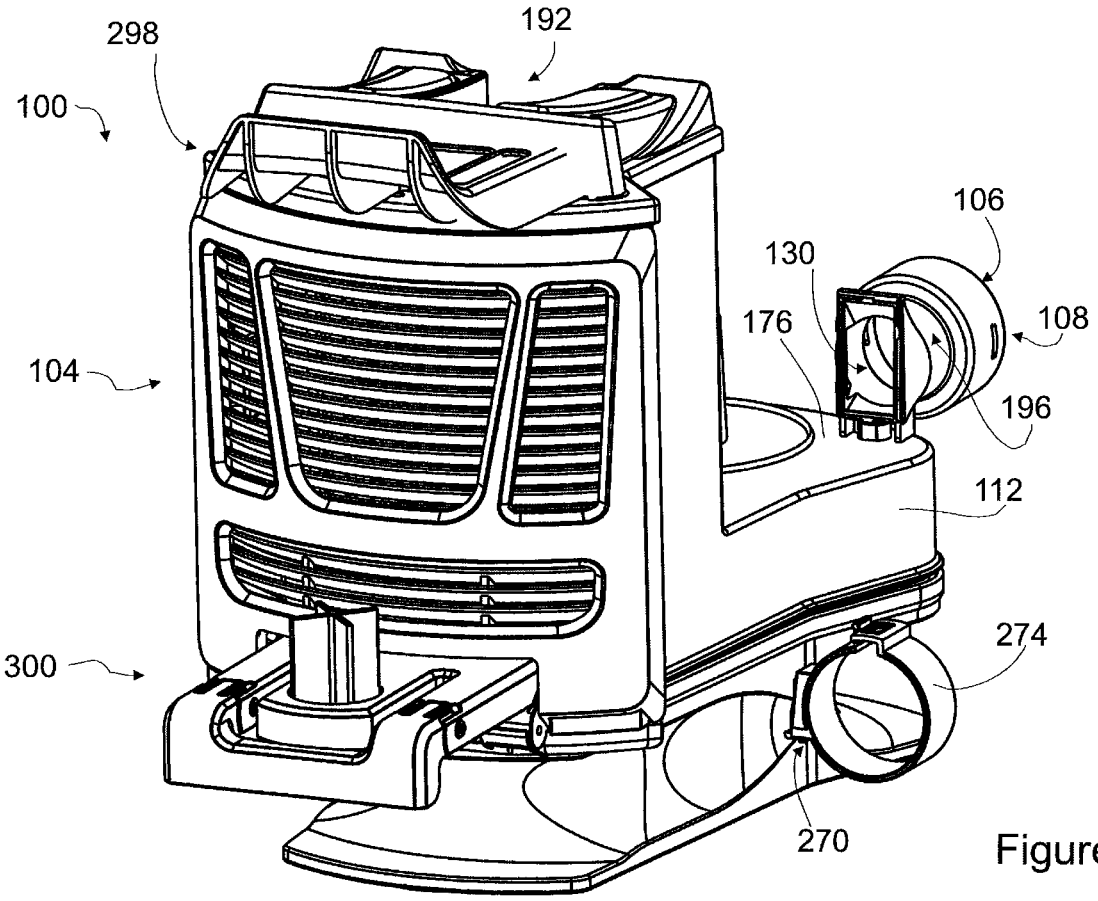
FIG. 9 is a rear perspective view of the surface cleaning apparatus of FIG. 1, with the cyclone bin assembly removed.

Referring to FIGS. 10-13, in the illustrated example, cyclone bin assembly 110 includes a cyclone chamber 118 and a dirt collection chamber 120. The cyclone chamber 118 is bounded by a sidewall 122, a first end wall 124 and a second end wall 126 that are configured to preferably provide an inverted cyclone configuration. A tangential air inlet 128 is provided in the sidewall of the cyclone chamber 118 and is in fluid communication with the air outlet 130 (FIG. 9) of the hose connector 108. Air flowing into the cyclone chamber 118 via the air inlet 128 can circulate around the interior of the cyclone chamber 118 and dirt particles and other debris can become disentrained from the circulating air. It will be appreciated that the cyclone chamber may be of any configuration and that one or more cyclone chambers may be utilized. In the example illustrated the cyclone bin assembly 110, and the cyclone chamber 118 are arranged in a generally vertical, inverted cyclone configuration. Alternatively, the cyclone bin assembly 110 and cyclone chamber 118 can be provided in another orientation, including, for example, as a horizontal cyclone.

Cyclone chamber 118 may be in communication with a dirt collection chamber 120 by any means known in the art. Preferably, as exemplified, the dirt collection chamber 120 is exterior to cyclone chamber 118, and preferably at least partially surrounds and, more preferably completely surrounds, cyclone chamber 118. Accordingly, cyclone chamber 118 is in communication with dirt collection chamber 118 via a dirt outlet 132. Preferably, the dirt outlet 132 comprises a slot 132 formed between the sidewall 122 and the first end wall 124. Slot 124 comprises a gap between an upper portion of cyclone chamber sidewall 122 and the lower surface of first end wall 124. Preferably, the gap extends only part way around sidewall 122. Debris separated from the air flow in the cyclone chamber 118 can travel from the cyclone chamber 118, through the dirt outlet 132 to the dirt collection chamber 120.

Air can exit the cyclone chamber 118 via an air outlet 134. In the illustrated example, the cyclone air outlet includes a vortex finder 134. Optionally, a removable screen 136 can be positioned over the vortex finder 134. The cyclone chamber 118 extends along a longitudinal cyclone axis 138 (FIG. 13). In the example illustrated, the longitudinal cyclone axis 138 is aligned with the orientation of the vortex finder 134.

The dirt collection chamber 120 comprises a sidewall 140, a first end wall 142 and an opposing second end wall 144. In the illustrated example, at least a portion of the dirt collection chamber sidewall 140 is integral with a portion of the cyclone chamber sidewall 122, at least a portion of the first cyclone endwall 124 is integral with a portion of the first dirt collection chamber end wall 142 and/or and at least a portion of the second cyclone end wall 126 is integral with a portion of the second dirt collection chamber end wall 144. The dirt collection chamber 120 extends along a dirt collection axis 146 (FIG. 146). Optionally, the dirt collection axis 146 can be parallel to and offset from the cyclone axis 138.

The dirt collection chamber 120 may be emptyable by any means known in the art and is preferably openable concurrently with the cyclone chamber 118. Preferably, the second dirt collection chamber end wall 142 is pivotally connected to, e.g., the dirt collection chamber sidewall 140, such as by hinges 212. The second dirt collection chamber end wall 144 can be opened (FIG. 12) to empty dirt and debris from the interior of the dirt collection chamber 120. In the illustrated example, the second cyclone end wall 126 is integral with, and is openable with, the second dirt collection chamber end wall 144. Accordingly, opening the second cyclone end wall 126 can allow dirt and debris to be emptied from the cyclone chamber 118 and the dirt collection chamber 120. The second dirt collection chamber end wall 144 can be retained in the closed position by any means known in the art, such as by a releasable latch 143.

Alternately, or in addition, as shown in the illustrated example, the first cyclone end wall 124 may be integral with, and is openable with, the first dirt collection chamber end wall 142. Accordingly, opening the first cyclone end wall 124 can allow dirt and debris to be emptied from the cyclone chamber 118 and the dirt collection chamber 120. The first dirt collection chamber end wall 142 can be retained in the closed position by any means known in the art, such as by a releasable latch.

A handle 152 is provided on the top of the cyclone bin assembly 110. The handle 152 is configured to be grasped by a user. When the cyclone bin assembly 110 is mounted on the body 112, the handle 152 can be used to manipulate the surface cleaning apparatus 100. When the cyclone bin assembly 110 is removed from the body 112, the handle 152 can be used to carry the cyclone bin assembly 110, for example to position the cyclone bin assembly 110 above a waste receptacle for emptying. In the illustrated example, the handle 152 is integral with a lid 154 of the cyclone bin assembly 110.

Securing the Cyclone Bin Assembly on the Main Body

Figure 7:
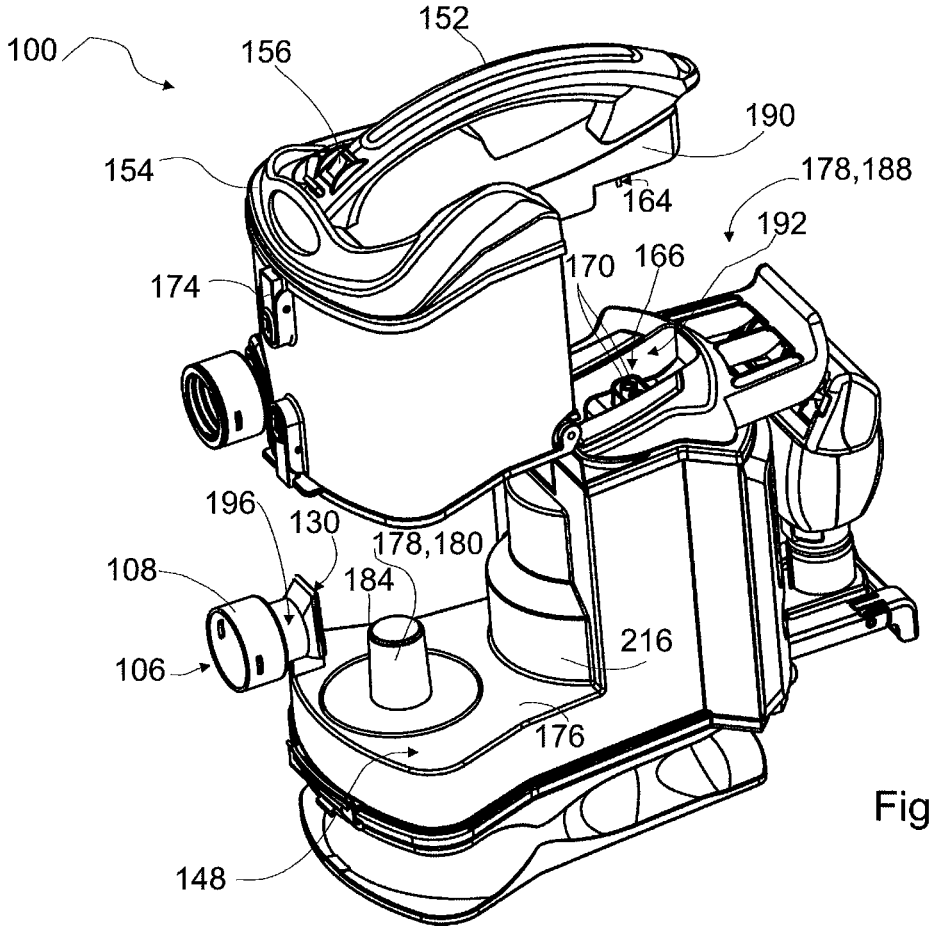
FIG. 7 is a top perspective view of the surface cleaning apparatus of FIG. 2, with a cyclone bin assembly separated from the body.
Figure 8:
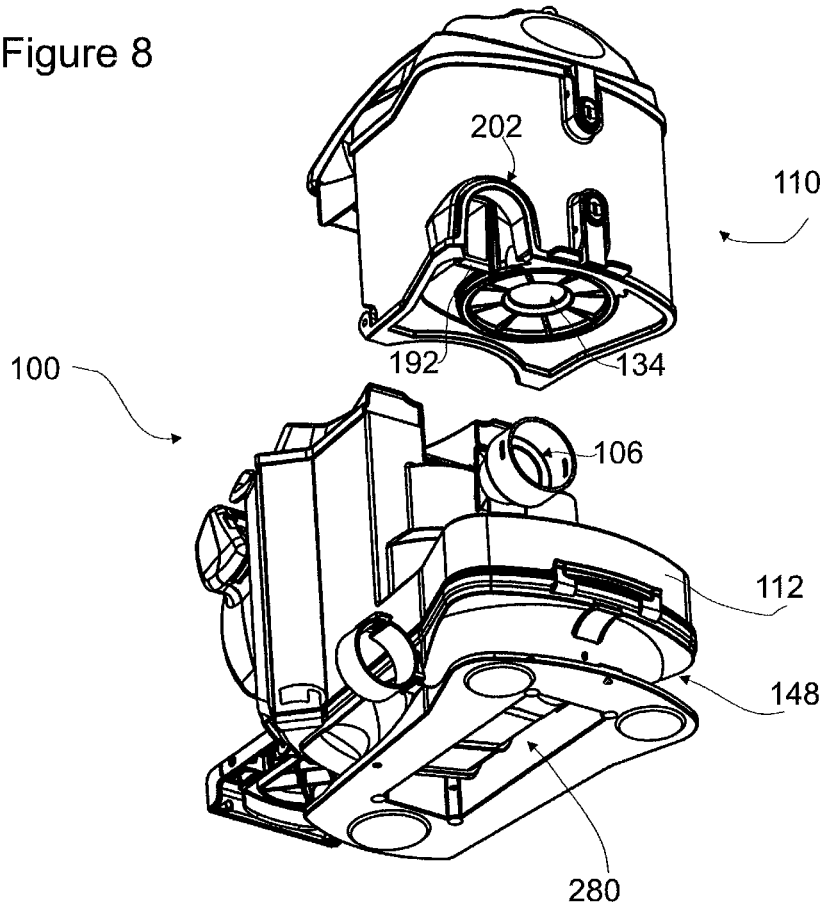
FIG. 8 is a bottom perspective view of the surface cleaning apparatus of FIG. 7.

Referring to FIGS. 7 and 8, optionally, the cyclone bin assembly 110 is detachably connected to the body 112. Preferably, as exemplified, the cyclone bin assembly 110 is detachably mounted on a platform 148. One or more releasable latches may be used to secure cyclone bin assembly 110 to main body 112. As exemplified, the rear surface of the cyclone bin assembly 110 abuts against the front wall of the suction motor housing 216 of the main body 112. Accordingly, a single releasable latch 150 (see for example FIG. 2) can be used to secure a front edge of the cyclone bin assembly 110 to the body 112 and thereby secure the cyclone bin assembly 110 to the main body 112. Alternately, two or more securing members may be provided.

Removable Main Power Switch

Referring to FIGS. 7, 8 and 13, a main power switch 156 for the surface cleaning apparatus 100 (e.g. for controlling the operation of the suction motor 114) is removable with cyclone bin assembly 110 and is preferably provided on the lid 154 of the cyclone bin assembly 110. The power switch 156 is connected to the suction motor 114 by a control circuit 158, and is operable to control the supply of power from a power source to the suction motor 114. Preferably, the power switch 156 is positioned in close proximity to the handle 152. Providing the power switch 156 close to, or optionally on, the handle 154 may help allow a user to operate the power switch 156 with the same hand that used to grasp the handle 154.

Control circuit 158 may be of various designs which include main power switch 156 and enable main power switch 156 to be used to selectively actuate the suction motor 114. As exemplified in FIG. 13, the control circuit 158 comprises electrical conduits, for example wires 160, which can be provided internally in cyclone bin assembly 110 (e.g., in an internal handle conduit 162). The plurality of wires 160 can electrically connect the switch 156 to a power source in the body 112 and/or the suction motor 114.

Figure 10:
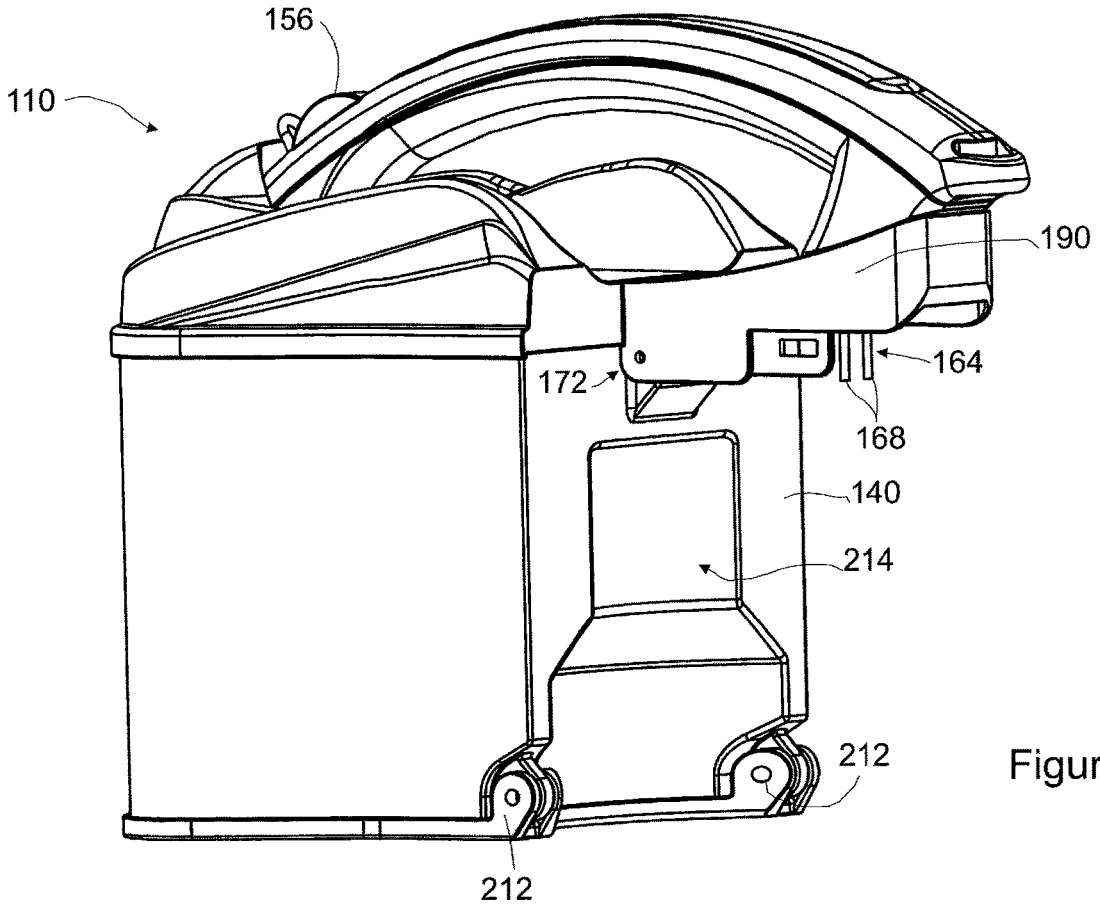
FIG. 10 is a rear perspective view of the cyclone bin assembly.
Figure 11:
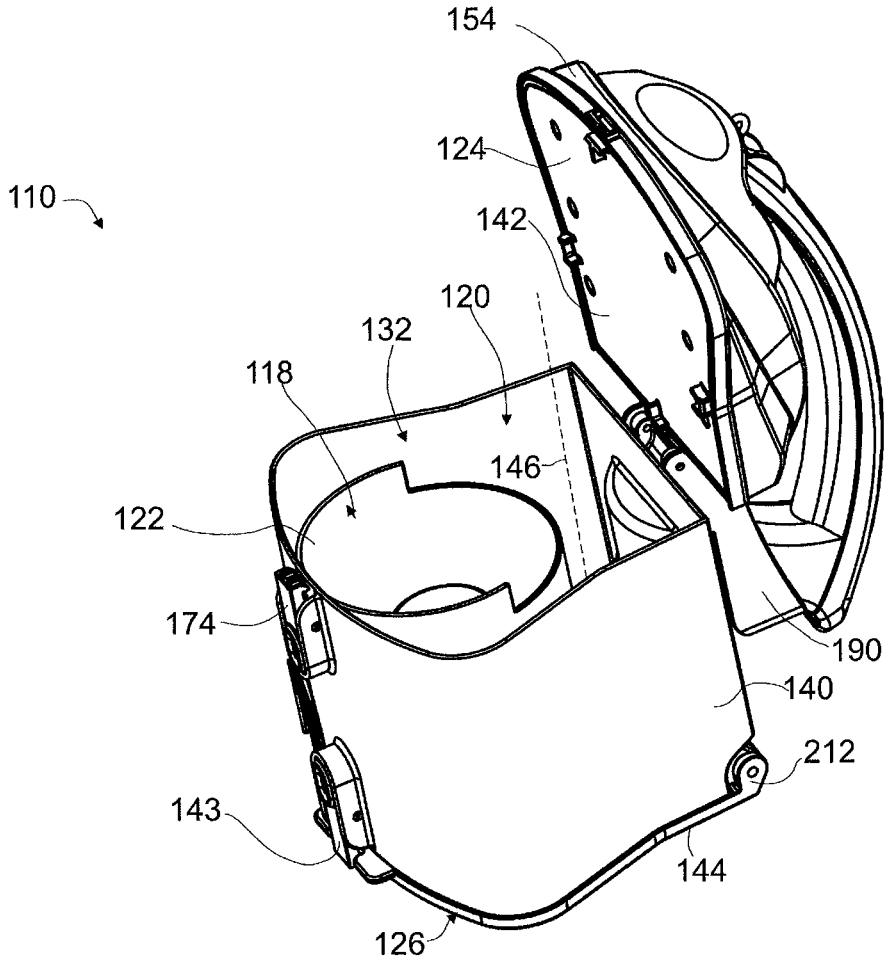
FIG. 11 is top perspective view of the cyclone bin assembly of FIG. 10, with the lid in an open position.

Referring to FIGS. 7 and 10, optionally, the control circuit 158 between the power switch 154 and the suction motor 114 comprises a decoupling member and is interruptible, and the power switch 158 can be detachable from the body 112. In the illustrated example, the decoupling member comprises first and second power connectors 164, 166. The lid 154 of the cyclone bin assembly 110 comprises a first power connector 164 and the body 112 comprises a second, mating power connector 166. When the cyclone bin assembly 110 is mounted on the body 112, the first power connector 164 is electrically coupled to the second power connector 166. Connecting the first and second power connectors 164, 166 can complete an electrical control circuit 158 between the power switch 156 and the suction motor 114 such that main power switch 156 may control the actuation of the suction motor. The first and second power connectors 164, 166 are releasably coupled and can be separated from each other to interrupt the electrical connection between the power switch 156 and the suction motor 114. In the illustrated example, separating the cyclone bin assembly 110 from the body 112 automatically separates the first and second power connectors 164, 166.

In the illustrated example the first power connector 164 is a male power connector, comprising two prongs 168, and the second power connector 166 is a female power connector comprising a two corresponding receptacles 170 to receive the prongs 168. Accordingly, the second power connector 166 can remain connected to a power supply when the cyclone bin assembly 110 is removed. Providing a female power connector 166 on the body 112, instead of a pair of exposed prongs 168, may help reduce the risk of electric shock to a user when the cyclone bin assembly 110 is removed, and the second power connector 166 is exposed.

Alternatively, instead of providing a continuous electrical connection between the power switch 156 and the suction motor 114, the connection between cyclone bin assembly 110 and the body 112 can be another type of control system. For example, instead of providing electrical wires 160 in the handle conduit 162, the control circuit 158 can comprise an electrical circuit housed in the main body that is interruptible by movement of main power switch, e.g., with the cyclone bin assembly 110, away from an in use position on main body 112. For example, a mechanical linkage system may be used. The mechanical linkage system (e.g., an abutment member such as a post) can be configured to translate movements of the power switch 156 to open and close a circuit in the main body. For example, the post may be driving connected to a relay positioned on the body 112 and that forms part of the circuit. The relay can then convert the movements of the mechanical linkage into electrical signals, optionally via onboard electronics, to control the suction motor 114. For example, removing the cyclone bin assembly 110 from the body 112 would move the post out of engagement with the relay thereby permitting the relay to open the circuit.

In another example, the power switch 156 may be connected to an RF (or other type of wireless transmitter) in the cyclone bin assembly 110, and the body 112 can include an RF receiver that can control the operation of the suction motor 114 (or vice versa). The surface cleaning apparatus 100 can also include a proximity sensor configured to sense whether the cyclone bin assembly 118 is mounted on the body 112. In this example, moving the power switch 156 may generate a wireless control signal that is received by the RF receiver. The proximity sensor can be communicably linked to at least one of the RF transmitter or RF receiver and can be configured to deactivate at least one of the RF transmitter or RF receiver when the cyclone bin assembly 110 is removed from the base. Alternately, the proximity sensor could be drivingly connected to a relay or the like to close the relay when the cyclone bin assembly is mounted to main body 112. For example, the proximity sensor could be provided in main body 12 and could be actuated by a magnet provided at a suitable location in cyclone bin assembly 110.

Optionally, the lid 154 need not be attached to cyclone bin assembly 110. Instead, lid 154 may be moveably mounted on main body 12, or removable therefrom, to permit cyclone bin assembly 110 to be removed. As exemplified in FIGS. 10 and 11, the lid 154 may be pivotally mounted to main body 12 by a hinge 172 and moveable between an open position (FIG. 11) wherein the cyclone bin assembly 110 may be removed and a closed position (FIG. 10) wherein the cyclone bin assembly is secured in position. In the illustrated example, the hinge 172 is provided toward the rear of the cyclone bin assembly 110. The lid 154 may be releasably retained in the closed position by any means, such as a latch 174 provided toward the front of the cyclone bin assembly 110. Opening the lid 154 may allow a user to access the interior of the dirt collection chamber 120 and cyclone chamber 118. Optionally, the screen 136 and/or the vortex finder 134 can be removable from the cyclone chamber 118 and can be removed via the top of the cyclone bin assembly 110 when the lid 154 is opened.

Alignment Members for Locating and Orienting the Cyclone Bin Assembly

Referring again to FIGS. 7-9 and 13, the platform 148 may comprise a generally planar bearing surface 176 for supporting the cyclone bin assembly 110. Optionally, the main body may comprise at least one alignment member configured to engage the cyclone bin assembly 110 and thereby align and/or orient the cyclone bin assembly for mounting on main body 12. Preferably at least one of the alignment members is provided on the platform 148. Providing at least one alignment member 178 may help a user to replace the cyclone bin assembly 110 on the platform 148 in a desired, operating position.

In the illustrated, the at least one alignment member 178 comprises a vortex finder insert 180 extending from the platform 148. The vortex finder insert 180 is a hollow conduit and is configured to fit within the vortex finder 134 in the cyclone bin assembly 110. In this configuration, the vortex finder insert 180 can comprise a portion of the air outlet of the cyclone chamber 118, and can comprise a portion of the air flow path between the dirty air inlet 102 and the clean air outlet 104.

Figure 12:
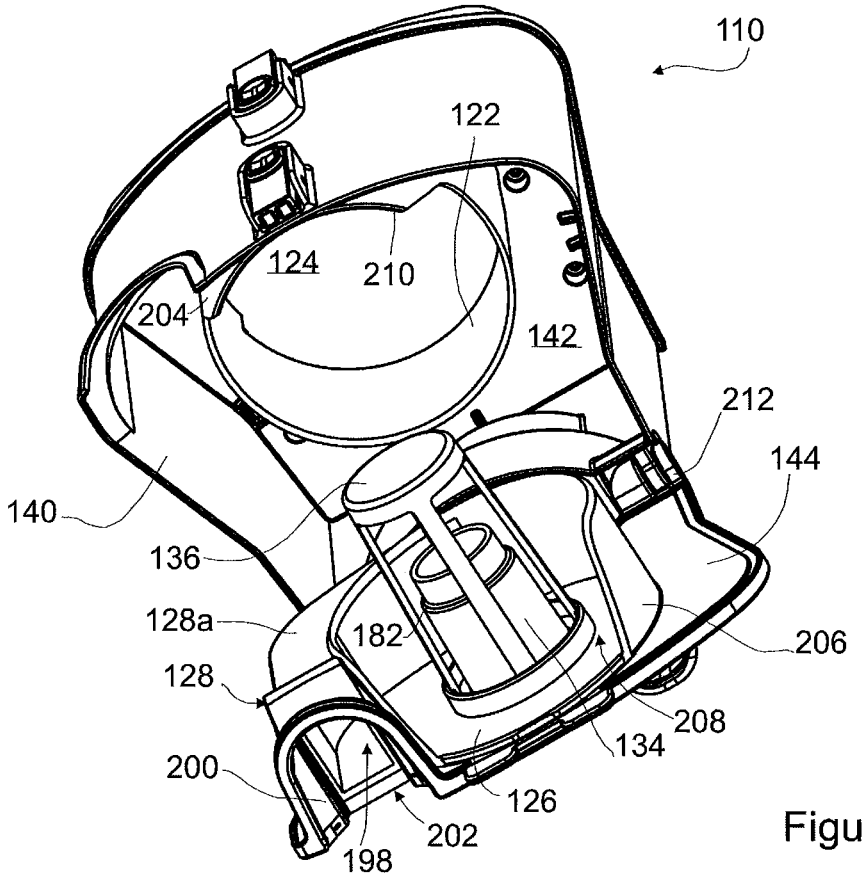
FIG. 12 is a lower perspective view of the cyclone bin assembly of FIG. 10, with the dirt collection chamber end wall in an open position; and, FIG. 13 is a section view of the surface cleaning apparatus of FIG. 2, taken along line 13-13.

Optionally, the vortex finder 134 can include an annular mounting shoulder 182 that is configured to rest on the upper face 184 of the vortex finder insert 180 (see also FIG. 12). With the cyclone bin assembly 110 seated on the platform 148, and the insert 180 received in the vortex finder 134, air exiting the cyclone chamber 118 can flow through both the vortex finder 134 and vortex finder insert 180 and into a filter chamber 186 in the body 112.

In the illustrated example, both the vortex finder 134 and vortex finder insert 180 have a circular cross sectional shape. Locating the vortex finder insert 180 within the vortex finder 134 can provide lateral alignment and front/back alignment of the cyclone bin assembly 110 on the platform 148, but may still allow relative rotation between the cyclone bin assembly 110 and the body 112.

Optionally, an engagement member can be provided to help retain the vortex finder insert 180 within the vortex finder 134. For example, a detent connection can be provided between the vortex finder insert 180 and the vortex finder 134 to help retain the vortex finder 134 on the insert 180.

Optionally, the cyclone bin assembly 110 can be configured so that vortex finder insert 180 serves as the vortex finder 134 in the cyclone chamber 118. In this configuration, vortex finder insert 180 may be removable received in the cyclone chamber 118. For example, the second cyclone endwall 126 may comprise an aperture that is sized to receive the vortex finder insert 180 and to create a generally air tight seal. With the cyclone bin assembly 110 seated on the platform 148, the vortex finder insert 180 is inserted into cyclone chamber 118 and may then serve as the vortex finder within the cyclone chamber 118. When the cyclone bin assembly 110 is removed, the vortex finder insert 180 is removed from cyclone chamber 118 and no vortex finder remains in cyclone chamber 118. Optionally, a relatively short annular lip can be provided around the perimeter of the aperture. The inner surface of the lip can rest against the outer surfaces of the vortex finder insert 180 and may help seal the cyclone chamber 118. The lip and/or vortex finder insert 180 can each be tapered, and optionally can be configured as a morse taper to help seal the cyclone chamber 118. Alternatively, the body 112 may not include a vortex finder insert 180, and the outlet of the vortex finder 134 can be sealed against an air inlet aperture in the platform 148.

Referring to FIGS. 7-10, optionally, the at least one alignment member 178 can also include at least one rotational alignment member 188. The rotational alignment member may be utilized to orient the cyclone bin assembly on main body 12. In the illustrated example, a tongue 190 extending from the rear of the cyclone bin assembly lid 154 can cooperate with a corresponding slot 192 in the body 112 to serve as a rotational alignment member 188. The slot 192 is sized and shaped to receive the tongue 190 in one desired alignment. When the tongue 190 is positioned within the slot 192 the cyclone bin assembly 110 is provided in the desired, operating and mounting orientation. The interaction between the tongue 190 and the slot 192 may also help provide lateral and front/back alignment of the cyclone bin assembly 110. Preferably, as exemplified, the first power connector 164 is provided on the underside of the tongue 190, and the second power connector 166 is provided within the slot 192.

Suction Hose Connector

Preferably, the suction hose connector 108 is mounted to the main body 112 so as to remain in position when the cyclone bin assembly 110 is removed. Alternately, or in addition, the hose connector 108 is nested or recessed into the cyclone bin assembly 110.

As exemplified, preferably the suction hose connector 108 is connected to the platform 148, and remains connected to the platform 148 when the cyclone bin assembly 110 is removed. The suction hose connecter 108 comprises an air inlet 106 that may be connectable to a suction hose and is in communication with the opposing air outlet 130. A throat portion 196 of the suction hose connector 108 optionally extends between the air inlet 106 and air outlet 130. Coupling the suction hose connector 108 to the body 112 may help facilitate the removal of the cyclone bin assembly 110 (for example to empty the dirt collection chamber 120) while leaving the suction hose connected to the body 112, via the suction hose connector 108.

The air outlet 130 is configured to connect to the tangential air inlet 128 of the cyclone chamber 118. Referring to FIGS. 8 and 12, in the illustrated example, a sealing face 198 on the tangential air inlet 128 is shaped to match the shape and orientation of the air outlet 130 of the suction hose connector 108. Optionally, a gasket 200, or other type of sealing member, can be provided at the interface between the sealing face 198 and the air outlet 130.

The air outlet 130 of the suction hose connector 108 and the sealing face 198 of the tangential air inlet 128 may preferably be configured so that the sealing face 198 can slide relative to the air outlet 130 (vertically in the illustrated example) as the cyclone bin assembly 110 is being placed on, or lifted off of, the platform 148. As the cyclone bin assembly 110 is lowered onto the platform 148, the sealing face 198 may slide into a sealing position relative to the air outlet 130. In the sealing position, the gasket 200 is preferably aligned with the walls of the air outlet 130.

Optionally, part or all of hose connector 108 is recessed or nested within cyclone bin assembly 110. An advantage of this design is that the length of the surface cleaning apparatus may be reduced. A further advantage is that the hose connector 108 may be protected from impact during use.

Accordingly, the sealing face 198 may be recessed within the cyclone bin assembly 110. In the illustrated example, the cyclone bin assembly 110 includes a notch 202 in a lower surface that is configured to receive the throat portion 196 of the suction hose connector 108 when the cyclone bin assembly 110 is placed on the platform 148. With the cyclone bin assembly 110 on the platform 148, at least a portion of the throat 196 and the air outlet 130 are nested within cyclone bin assembly 110, which can help seal the air outlet 130 with the sealing face 198.

It will be appreciated that by nesting the hose connector in cyclone bin assembly 110, the suction hose connector 108 can serve as a rotational alignment member 188 to help guide the cyclone bin assembly 110 into a desired orientation.

Alternatively, in other embodiments the suction hose connector 108 may be fixedly connected to the cyclone bin assembly 110, and may be removable with the cyclone bin assembly 110.

Cyclone Chamber Wherein Part of the Sidewall Moves with a Openable End Wall

Optionally, as exemplified in FIG. 12, the cyclone chamber sidewall 122 comprises a split sidewall that includes a first portion 204 and a second portion 206. The first portion 204 remains in position when the when the second dirt collection chamber end wall 144 is opened. For example, first portion 204 may be attached to, and may be integral with, the first dirt collection chamber end wall 142. The second portion 206 is movable with the second dirt collection chamber end wall 144. When assembled, with the second dirt collection chamber end wall 144 in the closed position, the first and second portions 204, 206 provide a generally continuous and generally air impermeable cyclone sidewall 122.

The second portion 206 may include a notch 208 that is shaped to receive a corresponding tab 210 on the first portion 204. Preferably, the notch 208 in the second portion 206 is provided toward the free end (i.e. opposed to the pivoting end) of the second dirt collection chamber end wall 126, and away from the hinge 212. Providing the notch 208 in this location may help enable dirt and debris to be emptied from cyclone chamber 118 and may help reduce the likelihood of dirt and debris being retained by within the cyclone chamber 118 when the second dirt collection chamber endwall 144 is opened. For example, when second end wall 126 is pivoted open and faces downwardly, dirt on the surface of end wall 126 may fall through notch 208. It will be appreciated that notch preferably extends all the way to the surface of end wall 126 and may extend varying amounts around the sidewall 122.

Inlet 128 has an upper surface **128*a* (see FIG. 12). In the preferred embodiment, inlet 128 extends through the dirt collection chamber 120 and is mounted or moveable with end wall 126. Accordingly, the upper surface 128*a* comprises a dirt settling surface of the dirt collection chamber 120. When the dirt collection chamber is opened, inlet 128 moves with end wall 128. Accordingly, upper surface 128*a* is exposed and may face downwardly, thereby allowing dirt that has accumulated on upper surface 128*a*** to be emptied.

Optionally, the vortex finder 134 and screen 136 are movable with the second cyclone endwall 126. In the illustrated example, the vortex finder 134 is integrally molded with the first cyclone endwall 124. In the illustrated example the dirt collection chamber sidewall 140 is a continuous, integral wall and does not split into upper and lower portions, or move with the second dirt collection chamber end wall 144.

Enhanced Dirt Collection Chamber Capacity

Preferably, the dirt collection chamber 120 surrounds a portion of the main body and, preferably a portion of the suction motor housing 216. Referring to FIGS. 7, 8, 10 and 13, the dirt collection chamber sidewall 140 comprises a recess 214 that is shaped to receive a corresponding portion of the body 112. In the illustrated example, the recess 214 is shaped to receive a portion of the motor housing 216 surrounding the suction motor 114. In this example, at least a portion of the dirt collection chamber 120 is positioned between the cyclone chamber 118 and the suction motor 114. Preferably, at least a portion of the dirt collection chamber 120 surrounds at least a portion of the suction motor 114 and the suction motor housing 216. In the illustrated example, the dirt collection chamber 120 surrounds only a portion of the motor housing 216. The shape of the recess 214 is preferably selected to correspond to the shape of the suction motor housing 216. Configuring the dirt collection chamber 120 to at least partially surround the suction motor housing 216 may help reduce the overall length of the surface cleaning apparatus 100, and/or may help increase the capacity of the dirt collection chamber 120.

The dirt collection chamber 120 may surround at least a portion of the cyclone chamber 118. Optionally, the dirt collection chamber 120 may be configured to completely surround the cyclone chamber 118.

Enhanced Filter Capacity

Preferably a filter (e.g., the pre-motor filter) overlies part or all of the cyclone bin assembly and the suction motor. This may increase the size of the pre-motor filter while maintaining a smaller footprint.

As exemplified in FIG. 13, air exiting the cyclone chamber 118 preferably flows to a suction motor 114 inlet via a filter chamber 186. The filter chamber 186 is provided downstream from the cyclone air outlet. Preferably, as exemplified, the filter chamber 186 extends over substantially the entire lower portion of the body 112 and overlies substantially all of the cyclone chamber 118, dirt collection chamber 120 and suction motor 114.

A pre-motor filter 218 is provided in the filter chamber 186 to filter the air before it enters the suction motor inlet 220. The pre-motor filter 218 is preferably sized to cover the entire transverse area of the filter chamber 186, and thereby overlies substantially all of the cyclone chamber 118, dirt collection chamber 120 and suction motor 114.

It will be appreciated that filter chamber 186 and pre-motor filter 218 may be smaller. Preferably, the cross sectional area (in the direction of air flow) of the pre-motor filter 218 is greater than the cross sectional area of the cyclone chamber 118 and/or the suction motor 114. In the illustrated example, the pre-motor filter 218 preferably comprises first and second pre-motor filters 218*a*, 218*b*. The filter chamber 186 comprises an air inlet chamber 222 on the upstream side 224 of the pre-motor filter 218, and an air outlet chamber 226 on the downstream side 228 of the pre-motor filter 218. Air can travel from the air inlet chamber 222 to the air outlet chamber 226 by flowing through the air-permeable pre-motor filter 218.

Preferably, the outer face (the side facing away from the cyclone air outlet) is the upstream side of the filter. Accordingly, the air inlet chamber 222 is spaced from and fluidly may be connected to the cyclone chamber air outlet by an inlet conduit 230 that extends through the pre-motor filter 218. In the illustrated example, the inlet conduit 230 is an extension of the vortex finder insert 180. The air outlet chamber 226 is in fluid communication with the inlet 220 of the suction motor 114.

The pre-motor filter 218 may be supported by a plurality of support ribs 232 extending through the air outlet chamber 226. Gaps or cutouts 234 can be provided in the ribs 232 to allow air to circulate within the air outlet chamber 226 and flow toward the suction motor inlet 220.

From the suction motor inlet 220, the air is drawn through the suction motor 114 and ejected via a suction motor outlet 116. Optionally, a post-motor filter 236 (for example a HEPA filter) can be provided downstream from the suction motor outlet 116, between the suction motor outlet 116 and the clean air outlet 104. A detachable grill 238 can be used to retain the post-motor filter 236 in position, and allow a user to access the post-motor filter 236 for inspection or replacement.

A bleed valve 240 may be provided to supply bleed air to the suction motor inlet 220 in case of a clog. The bleed valve 240 may be a pressure sensitive valve that is opened when there is a blockage in the air flow path upstream from the suction motor 114. Preferably, as exemplified, the bleed valve 240 may be co-axial with the suction motor 114 and may extend through the pre-motor filter 218. A bleed valve inlet 242 (see also FIG. 5) may be provided toward the rear of the body 112.

Optionally, a first end wall 244 of the filter chamber 186 can be openable to allow a user to access the pre-motor filter 218. In the illustrated example, the filter chamber end wall 244 is pivotally connected to the body 112 by a hinge 246 and can pivot to an open position. Releasable latch 150 may be used to secure the first end wall 244 in a closed position. The latch 150 can connect the filter chamber endwall to the cyclone bin assembly 110.

Hose Wrap

Preferably, a suction hose wrap is provided and the accessory tools are provided in a recess in the hose wrap and, preferably, in the bottom of the hose wrap. Alternately, or in addition, the suction hose wrap is located at one end of the vacuum cleaner (e.g., the bottom) and preferably is the stand of the vacuum cleaner (i.e., it is the part that sits on the floor).

Referring to FIGS. 1-9, the surface cleaning apparatus 100 may include a hose wrap portion 248, which may be of any design. The hose wrap portion 248 may be provided at either opposed end (e.g. top or bottom if oriented upright as illustrated) of the surface cleaning apparatus. Preferably, as exemplified, the hose wrap portion 248 extends from the bottom surface of the openable filtration chamber end wall 244 or, if an openable filter chamber is not provided, from the bottom of the platform.

Preferably, the hose wrap portion 148 functions as a stand for the surface cleaning apparatus. Accordingly, referring to FIG. 7, the hose wrap portion 248 may include a generally flat lower surface 250 and therefore function as a stand to support the surface cleaning apparatus 100 when it is not in use. Optionally, the lower surface 250 can function as a stand and can include a plurality of support feet 252 configured to rest upon a surface (for example a floor or a counter top). In the illustrated example, the surface 250 includes three integral support feet 252 formed from bosses extending from the lower surface 250.

Preferably, as exemplified in FIGS. 1-6, a suction hose recess 254 extends around the perimeter of the hose wrap portion 248. The suction hose recess 254 preferably has a radius of curvature 256 (FIG. 6) that is selected to generally match the radius of curvature of a suction hose 109 that can be used in combination with the surface cleaning apparatus 100. When the suction hose 109 is not in use, it can be wrapped around the hose wrap portion 248 for storage and may be at least partially received in the suction hose recess 254.

Figure 3:
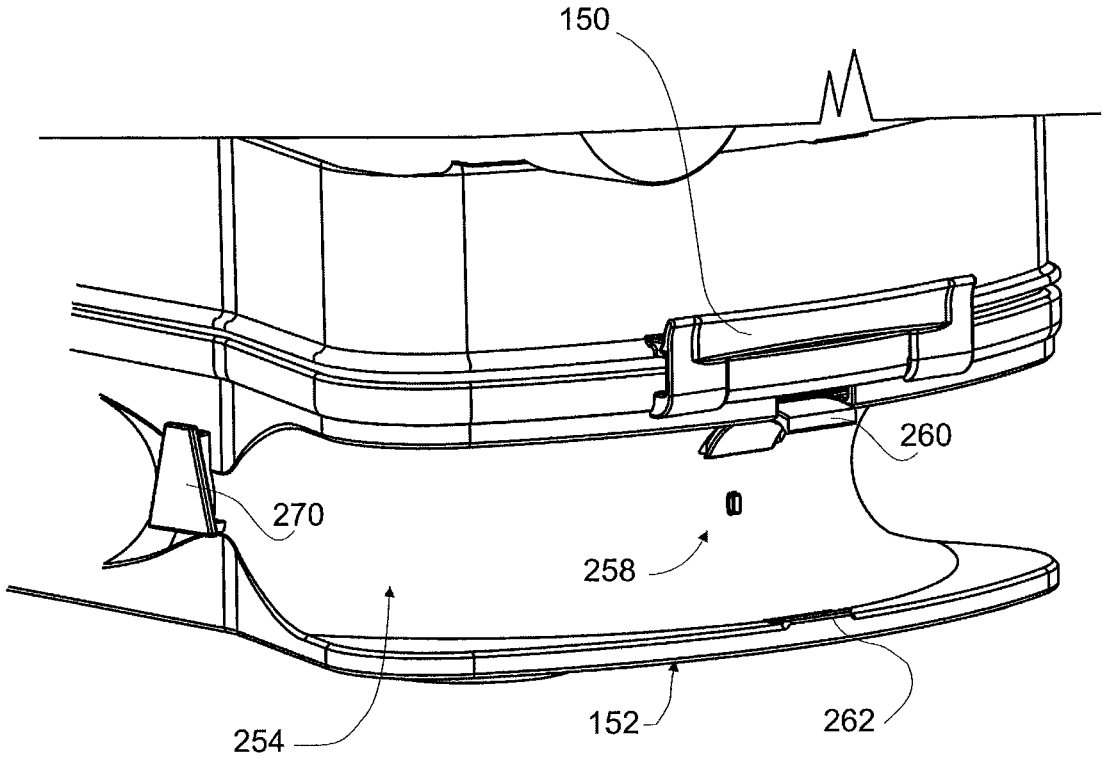
FIG. 3 is an enlarged view of a base portion of the surface cleaning apparatus of FIG. 2.

Referring to FIGS. 1-3, optionally, the suction hose recess 254 can include a hose securing detent 258, comprising upper and lower detent members 260, 262. The upper and lower detent 260, 262 members can frictionally engage a corresponding segment 264 of the suction hose 109. Engaging the suction hose 109 with the hose securing detent 258 may help retain the hose 109 in its storage position, within the hose recess 254. The suction hose segment 264 can include a hose detent groove 266 for receiving the upper and lower detent members 260, 262. Retaining the upper and lower detent members 260, 262 in the hose detent groove 266 can help prevent the suction hose 109 from sliding axially relative within the recess 254 while the suction hose 109 is wrapped in the recess 254. Optionally, the segment 264 of the suction hose retained by the upper and lower detent members 260, 262, and comprising the hose detent groove 266 can be separate hose retaining member 268 coupled to the suction hose 109. The hose retaining member 268 may be stiffer than the suction hose 109.

Alternatively, or in addition to the hose securing detent 258, the hose wrap portion 248 can include a hose securing member. In the illustrated example, the hose securing member comprises a mounting flange 270 that is shaped to engage a corresponding mounting notch 272 located on the suction hose 109. Sliding the mounting notch 272 over the flange 270 can help secure the upstream end of the suction hose in the storage position, in close proximity to the hose wrap portion 248. Optionally, the mounting notch 272 can be formed on a separate collar 274 that is coupled to the suction hose 109.

Referring to FIG. 13, in the illustrated example, the hose wrap portion 248 is arranged so that when the suction hose 109 is wrapped within the hose wrap recess 254, the plane 276 containing the suction hose is generally orthogonal to a cyclone axis 138 and a suction motor axis 278, as explained in greater detail below. Alternatively, the hose wrap portion 248 can be configured so that the plane 276 containing the suction hose is not orthogonal to one or both of the cyclone and suction motor axes 138, 278.

In the illustrated example, the hose wrap portion 248 is integrally formed from molded plastic. Optionally, the hose wrap portion 248 can be releasably connected to the body 112, and may be removable.

Figure 6:
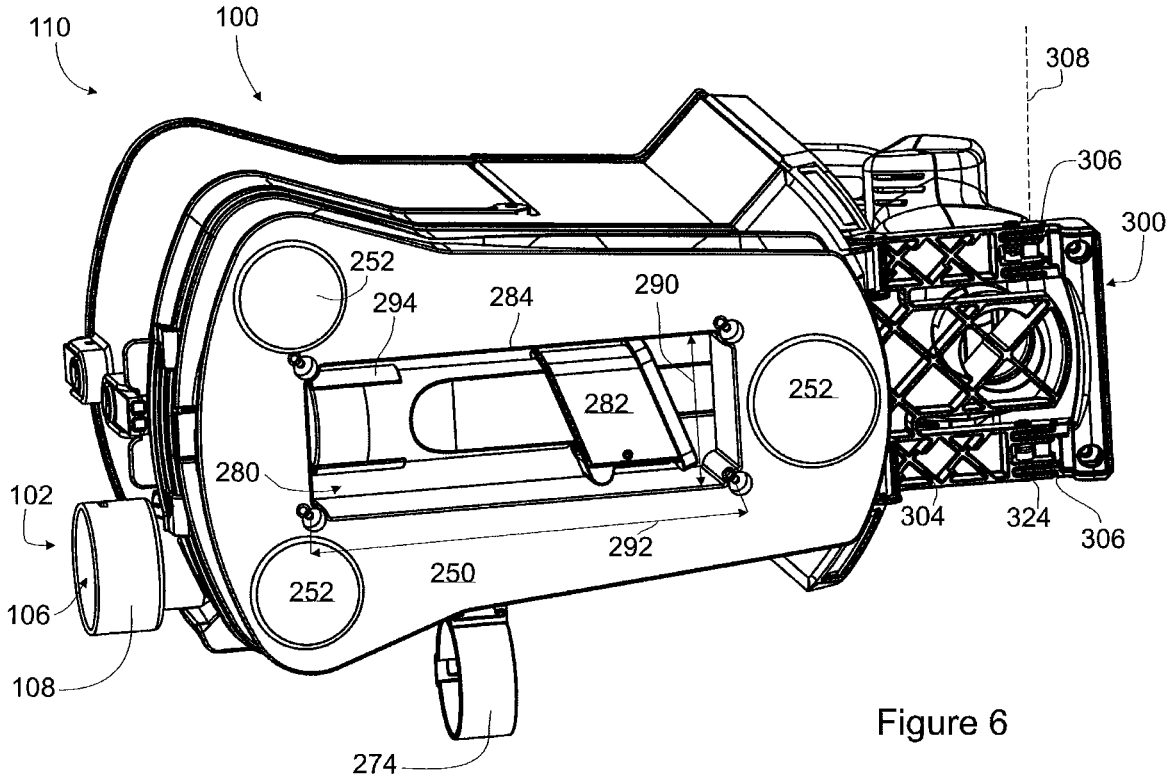
FIG. 6 is a bottom perspective view of the surface cleaning apparatus of FIG. 2.

Referring to FIGS. 6, 8 and 13, optionally, the hose wrap portion 248 can include a tool cavity 280. Preferably, as exemplified, the tool cavity 280 is provided in the lower surface of the hose wrap 248 and, more preferably generally centrally located within the perimeter of the hose wrap recess 254. One or more accessory cleaning tools 282 may be stored within the tool cavity 280 when the accessory tools 282 are not in use.

Preferably, as exemplified, the tool cavity 280 may include four side walls 284, an upper wall 286 and has an open bottom for allowing access to the tool stored 282 in the cavity 280. The tool cavity 280 has a cavity depth 288, a cavity width 290 and a cavity length 292. Alternatively, the tool cavity 280 may have an enclosed bottom and at least one open side 284 to allow access to the accessory tool 282, and/or the tool cavity 280 may include more than one open surface (for example the cavity may have an open bottom and at least one open side) or may have an openable door to provide access to the cavity. Preferably, the tool cavity 280 is configured so that the accessory tools 282 stored within the cavity 280 are accessible when the surface cleaning apparatus 100 is in use. More preferably, the tool cavity 280 is configured so that the accessory tools 282 in the cavity 280 are accessible while the suction hose is wrapped around the hose recess 254.

Optionally, the tool cavity 280 may include tool holders 294 for releasably securing one or more accessory tools 282 within the tool cavity 280. Preferably, as exemplified, the tool holder 294 comprises a tool mounting bracket extending from the upper wall 286 of the tool cavity 280. Preferably, as exemplified, the cavity depth 288 is selected to be greater than the thickness of the accessory tool 282 that is contained within the cavity 280, and the cavity width 290 and length are selected to be greater than the accessory tool width and length, respectively. Selecting a cavity 280 that is generally larger than the accessory tool 282 allows the accessory tool to be contained within the tool cavity 280, without extending beyond the lower surface 250 of the hose wrap portion 248. Recessing the accessory tool 282 within the cavity 280 may help enable the surface cleaning apparatus 100 to rest in a level orientation when the surface 250 is placed on a flat surface.

Cord Wrap

Preferably, a cord wrap is provided that permits the sliding removal of the cord without manually manipulating a cord retaining member (e.g., rotating a cord retaining member in a plane in which the cord is positioned when wrapped about the cord wrap).

Figure 4:
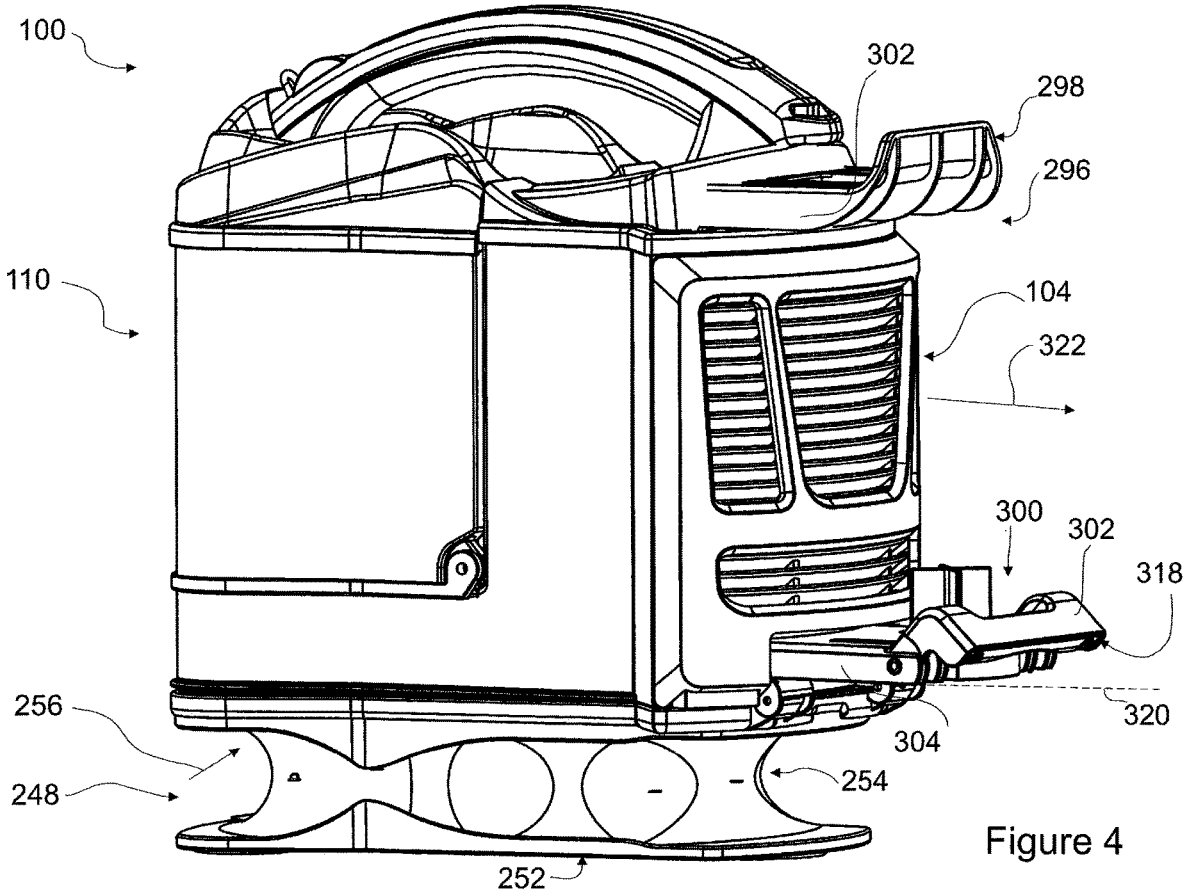
FIG. 4 is a side view of the side of the surface cleaning apparatus shown in FIG. 2, with a cord retainer in a cord removal position.
Figure 5:
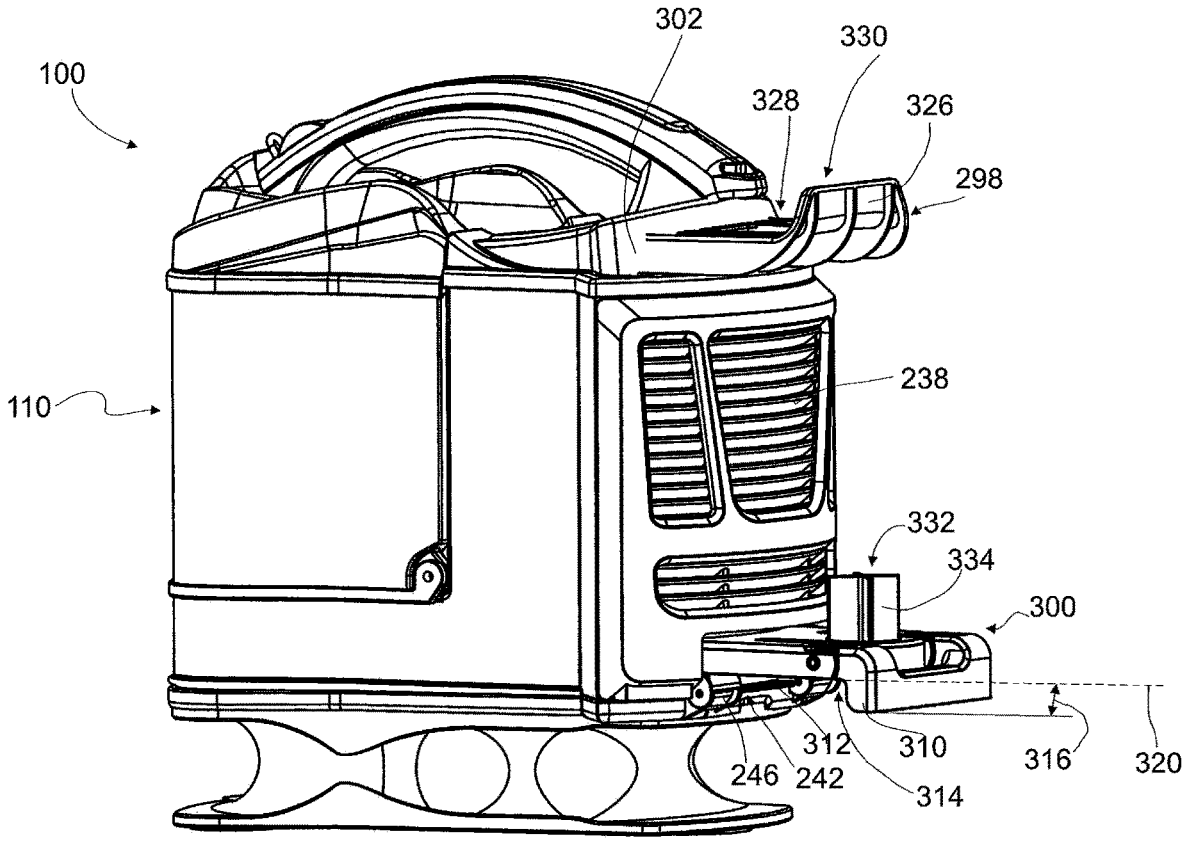
FIG. 5 is a rear perspective view of the surface cleaning apparatus of FIG. 2, with a cord retainer in a cord retaining position.

Referring to FIGS. 4-6, the surface cleaning apparatus 100 may optionally include an electrical cord wrap 296 extending, preferably, from the rear of the body 112. The electrical cord wrap 296 comprises and at least two spaced apart cord retainers, e.g., upper cord retainer 298 and an opposing lower cord retainer 300 about which an electrical cord may be wound for storage. In the illustrated example, the upper cord retainer 298 is connected to the body 112 by an upper extension member 302, and the lower cord retainer 300 is connected to the body 112 by a lower extension member 304. Extension members are optionally provided if the location of the cord wrap is to be spaced from main body 12.

Preferably, at least one of the upper and lower cord retainers 298, 300 is moveable in a sliding cord removing direction, between a cord storage position, for retaining the electrical cord on the cord wrap, and a cord removal position, to help facilitate the removal of the electrical cord from the cord wrap. Optionally, the moveable cord retainer includes a biasing member that is configured to bias the cord retainer toward the cord storage position. Preferably, a locking member is not provided to lock the cord wrap member in a cord retaining position. Accordingly, a user may remove the cord by sliding the cord off of the cord wrap member. The cord wrap member will then automatically return to the cord retaining position. When desired, the cord may then be wrapped about the cord retaining members. Alternately, the cord wrap member may be manually positionable in both the cord retaining position and the cord removal position.

In the illustrated example, the lower cord retainer 300 is movably coupled to the lower extension member 304 by pivot joints 306. The lower cord retainer 300 is pivotable about rotational axis 308 (FIG. 6) and is moveable between a cord storage position (FIG. 5) and a cord removal position (FIG. 4).

Referring to FIG. 5, in the cord storage position, a retaining flange 310 extends generally transverse (e.g. downwardly), away from the lower extension member 304 and cooperates with a cord supporting surface 312 of the lower extension member 304 to form a retaining shoulder 314. The height 316 of the retaining shoulder 314 can be selected so that it is sufficient to retain the electrical cord on the lower cord retainer 300, and optionally, can be generally equal to or greater than the diameter of the electrical cord.

Referring to FIG. 4, in the cord removal position, the lower cord retainer 300 is pivoted or moved in the cord removal direction (e.g. rearwardly) so that a distal end 318 of the retaining flange 310 is raised above a plane 320 containing the cord supporting surface 312. Pivoting the retaining flange 310 above the plane 320 may help facilitate removal of the electrical cord coiled around the cord wrap 296. When the lower cord retainer 300 is in the cord removal position, the lower end of the coiled electrical cord can be slid off the lower extension member 304, in the direction indicated using arrow 322, without needing to pass over the retaining shoulder 314.

Preferably, the lower cord retainer 300 is biased toward the cord storage position. Referring to FIG. 6, in the illustrated example, each pivot joint 306 includes a spring member 324 biasing the lower cord retainer 300 toward the cord storage position. The stiffness of the springs 324 can be selected so that the lower cord retainer 300 can remain in the cord storage position and retain the electrical cord on the cord wrap 296 under normal handling, for example when the orientation of the surface cleaning apparatus 100 is changed while the electrical cord is wrapped. Optionally, the stiffness of the springs 324 can also be selected so that the force of a user pulling the coiled electrical cord off the cord wrap 269 is sufficient to overcome the spring force. Configuring the springs 324 to yield when a user attempts to remove the electrical cord from the cord wrap 296 may help facilitate an automatic rotation of the lower cord retainer 300, allowing the cord to be removed without requiring the user to first manually adjust the position of the lower cord retainer 300. When the electrical cord is clear of the lower cord retainer 300, the biasing force of the springs 324 may return the lower cord retainer 300 to the cord storage position. Automatically returning the lower cord retainer 300 to the cord storage position may help ensure that the cord wrap 296 is configured to retain the electrical cord when the user chooses to replace the electrical cord on the cord wrap 296.

Optionally, instead of, or in addition, to one or more springs 324, the biasing member for returning the lower cord retainer to the cord storage position may be another type of biasing device, including, for example an elastic member and a living hinge.

Referring to FIG. 5, in the illustrated example, the upper cord retainer 298 is a static cord retainer. The upper cord retainer 298 includes a static flange 326 (i.e., non-moveable) that cooperates with the cord supporting surface 328 of the upper extension member 302 to provide a cord retaining shoulder 330. In the illustrated example, the upper cord retainer 298 is integrally formed with the upper extension member 302. Optionally, in other embodiments the lower cord retainer 300 can be static and the upper cord retainer 300 can be the moveable cord retainer, or both the upper and lower cord retainers 298, 300 can be movable. In the illustrated example, the upper and lower cord retainers 298, 300 are located on opposite ends of the clear air outlet 104.

Optionally, an accessory tool holder 332 may be provided on the electrical cord wrap 296. Referring to FIGS. 5 and 6, the accessory tool holder comprises a tool mounting post 334 extending upward from the lower extension member 304. The tool mounting post 334 is sized to be received within the air outlet 338 of an accessory cleaning tool, including, for example a turbo brush 336 (FIG. 4). Preferably, the tool mounting post 334 has a slight friction or interference fit with the inner surface of the air outlet 338. Providing an interference fit between the tool mounting post 334 and the accessory tool may help to retain the accessory tool on the tool mounting post when the surface cleaning apparatus 100 is in use. Optionally, the interference fit between the tool mounting post 334 and the accessory tool may be the only retaining mechanism used to hold the turbo brush on the surface cleaning apparatus 100. Alternatively, or in addition to the interference fit, additional retaining mechanisms, including for example, clips, latches and magnets, can be used to help hold the turbo brush on the tool mounting post.

Preferably, the upper and lower cord retainers 298, 300 are spaced apart from each other by a distance that allows for at least a portion of the accessory tool to be disposed between the upper and lower cord retainers 298, 300. In this configuration, the accessory tool can be positioned relatively close to the rear of the body 112. Positioning the turbo brush 336 in close proximity to the body 112 may help reduce the overall length of the surface cleaning apparatus 100.

It will be appreciated that the following claims are not limited to any specific embodiment disclosed herein. Further, it will be appreciated that any one or more of the features disclosed herein may be used in any particular combination or sub-combination, including, without limitation, a moveable or removable power switch (preferably on or proximate the handle), a hose connector that is recessed into the cyclone bin assembly and preferably having the hose connector mounted to the main body and not a removable air treatment member, a suction hose wrap with a tool storage compartment, a suction hose wrap provided at one end, and preferably a lower end, of a surface cleaning apparatus whereby it may form a stand or base, a cord wrap with an automatic cord release which permits the sliding removal of the cord without having to manually move a cord retaining member, a cyclone chamber having a removable vortex finder or vortex finder insert, A dirt bin that partially surrounds the suction motor or suction motor housing, a filter that overlies at least part of a cyclone bin assembly and a suction motor and a cyclone chamber having a wall that splits when the cyclone chamber is opened.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) an air flow path extending from a dirty air inlet to a clean air outlet;

(b) a main body having a suction motor provided in the air flow path, the suction motor having a suction motor inlet end, wherein the suction motor inlet end is provided at a lower end of the suction motor when the surface cleaning apparatus is located on a floor;

(c) an air treatment member assembly provided in the air flow path, the air treatment member assembly is removably mounted to the main body, the air treatment member assembly has an upper end, a lower end and a sidewall extending between the upper and lower ends wherein a portion of the sidewall forms an exterior surface of the surface cleaning apparatus when the air treatment member assembly is mounted to the main body, wherein a handle is provided on the upper end of the air treatment member assembly and the upper end of the air treatment member assembly comprises an openable end, wherein a dirt collection region of the air treatment member assembly is emptyable when the openable end is in an open position, the air treatment member assembly has an air treatment member assembly air outlet, wherein the air treatment member assembly air outlet is provided at the lower end of the air treatment member assembly when the surface cleaning apparatus is located on a floor; and, (d) a pre-motor filter underlying the air treatment member assembly and the suction motor when the air treatment member assembly is mounted to the main body.

2. The surface cleaning apparatus of claim 1 wherein the handle also overlies the suction motor.

3. The surface cleaning apparatus of claim 1 wherein the dirty air inlet is at a front end of the surface cleaning apparatus and the air treatment member assembly is positioned between the dirty air inlet and the suction motor.

4. The surface cleaning apparatus of claim 1 wherein a bleed valve extends through the pre-motor filter.

5. The surface cleaning apparatus of claim 1 wherein the air treatment member assembly is removable in the absence of opening a compartment of the main body.

6. A surface cleaning apparatus comprising:

(a) an air flow path extending from a dirty air inlet to a clean air outlet;

(b) a main body having a platform and a suction motor provided in the air flow path;

(c) an air treatment member assembly provided in the air flow path, the air treatment member assembly is removably mounted on the platform, the air treatment member assembly has an upper end, a lower end, first and second opposed sides, and a sidewall extending between the upper and lower ends wherein the sidewall comprises first and second opposed sidewall faces, the air treatment member assembly having an openable door wherein a dirt collection region of the air treatment member assembly is emptyable when the openable door is in an open position; and, (d) a pre-motor filter underlying the air treatment member assembly when the air treatment member assembly is mounted on the platform wherein, when the air treatment member assembly is mounted on the platform, the first sidewall face is on the first side of the air treatment member assembly and faces the main body, the second sidewall face is on the second side of the air treatment member assembly and has an upper portion located at the upper end of the air treatment member assembly, the upper end on the second side of the air treatment member assembly has an absence of the main body whereby the upper portion of the second sidewall face forms an exterior surface of the surface cleaning apparatus.

7. The surface cleaning apparatus of claim 6 wherein a handle is provided on the upper end of the air treatment member assembly.

8. The surface cleaning apparatus of claim 7 wherein the upper end of the air treatment member assembly comprises the openable door.

9. The surface cleaning apparatus of claim 8 wherein the upper end of the air treatment member assembly comprises the openable door.

10. The surface cleaning apparatus of claim 6 wherein the handle also overlies the suction motor.

11. The surface cleaning apparatus of claim 6 wherein the pre-motor filter is positioned below the platform.

12. The surface cleaning apparatus of claim 6 further comprising an air treatment member assembly air outlet, wherein the air treatment member assembly air outlet is provided at a lower end of the air treatment member assembly when the surface cleaning apparatus is located on a floor.

13. The surface cleaning apparatus of claim 12 further comprising a suction motor inlet end, wherein the suction motor inlet end is provided at a lower end of the suction motor when the surface cleaning apparatus is located on a floor.

14. The surface cleaning apparatus of claim 6 wherein the dirty air inlet is at a front end of the surface cleaning apparatus and the air treatment member assembly is positioned between the dirty air inlet and the suction motor.

15. The surface cleaning apparatus of claim 6 wherein the pre-motor filter also underlies the suction motor.

16. The surface cleaning apparatus of claim 6 wherein a bleed valve extends through the pre-motor filter.

17. The surface cleaning apparatus of claim 6 wherein the air treatment member assembly is removable in the absence of opening a compartment of the main body.

18. A surface cleaning apparatus comprising:

(a) an air flow path extending from a dirty air inlet to a clean air outlet;

(b) a main body having, a first side, an opposed second side, a suction motor provided in the air flow path and an accessory tool mount, the accessory tool mount is provided on the second side of the main body;

(c) an air treatment member assembly provided in the air flow path, the air treatment member assembly is removably mounted to the main body, the air treatment member assembly has an upper end, a lower end, first and second opposed sides, and a sidewall extending between the upper and lower ends, the air treatment member assembly has an openable door whereby a dirt collection region of the air treatment member assembly is emptyable when the openable door is in an open position wherein, when the air treatment member assembly is mounted to the main body, a portion of the sidewall forms an exterior surface of the surface cleaning apparatus and the first side of the air treatment member assembly faces the first side of the main body whereby, when an accessory tool is mounted to the accessory tool mount and the air treatment member assembly is mounted to the main body, the accessory tool is on an opposed side of the main body to the air treatment member assembly; and, (d) a pre-motor filter underlying the air treatment member assembly and the suction motor when the air treatment member assembly is mounted to the main body.

19. The surface cleaning apparatus of claim 18 further comprising an air treatment member assembly air outlet and the openable door is provided on an end of the air treatment member assembly having the air treatment member assembly air outlet.

20. The surface cleaning apparatus of claim 18 wherein the upper end of the air treatment member assembly comprises the openable door.

21. The surface cleaning apparatus of claim 20 wherein a handle is provided on the openable door.

* * * * *